US010152907B2

(12) United States Patent
Nishimura et al.

(10) Patent No.: US 10,152,907 B2
(45) Date of Patent: Dec. 11, 2018

(54) CIRCUIT DEVICE, ELECTRO-OPTICAL APPARATUS, AND ELECTRONIC INSTRUMENT

(71) Applicant: SEIKO EPSON CORPORATION, Tokyo (JP)

(72) Inventors: Motoaki Nishimura, Chino (JP); Akihiko Ito, Tatsuno-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 112 days.

(21) Appl. No.: 15/282,047

(22) Filed: Sep. 30, 2016

(65) Prior Publication Data

US 2017/0103695 A1 Apr. 13, 2017

(30) Foreign Application Priority Data

Oct. 13, 2015 (JP) ..... 2015-201981

(51) Int. Cl.
*G09G 5/10* (2006.01)
*G09G 3/20* (2006.01)
*G09G 3/36* (2006.01)

(52) U.S. Cl.
CPC ..... *G09G 3/2018* (2013.01); *G09G 3/3607* (2013.01); *G09G 3/3614* (2013.01); *G09G 3/3648* (2013.01); *G09G 3/3677* (2013.01); *G09G 3/3688* (2013.01); *G09G 2310/027* (2013.01); *G09G 2310/0254* (2013.01); *G09G 2310/0291* (2013.01); *G09G 2310/0297* (2013.01); *G09G 2310/08* (2013.01)

(58) Field of Classification Search
None
See application file for complete search history.

(56) References Cited

U.S. PATENT DOCUMENTS

| | | | | |
|---|---|---|---|---|
| 6,075,505 | A | 6/2000 | Shiba et al. | |
| 6,552,707 | B1 | 4/2003 | Fujiyoshi | |
| 7,088,328 | B2 | 8/2006 | Inada et al. | |
| 7,548,288 | B2 | 6/2009 | Kim et al. | |
| 8,890,786 | B2 | 11/2014 | Moon et al. | |
| 2016/0042695 | A1* | 2/2016 | Park | G09G 3/3614 345/690 |

FOREIGN PATENT DOCUMENTS

| | | |
|---|---|---|
| JP | 10-073843 A | 3/1998 |
| JP | 10-142578 A | 5/1998 |

* cited by examiner

*Primary Examiner* — Stephen T Reed
(74) *Attorney, Agent, or Firm* — Oliff PLC

(57) ABSTRACT

A display panel has a first pixel group selected by a first scan line, and second pixel group selected by second scan line. A data line is shared by pixel in the first pixel group and a pixel in the second pixel group. In first scanning period, a driving unit in a circuit device outputs a data voltage with first polarity to the first data line, and outputs data voltage with second polarity, which is polarity opposite to the first polarity, to the second data line. In second scanning period, the driving unit outputs a data voltage with third polarity to the first data line, and outputs a data voltage with fourth polarity, which is polarity opposite to the third polarity, to the second data line. A polarity setting unit in the circuit device sets the first polarity, the second polarity, the third polarity, and the fourth polarity.

14 Claims, 18 Drawing Sheets

CIRCUIT DEVICE, ELECTRO-OPTICAL APPARATUS, AND ELECTRONIC INSTRUMENT

BACKGROUND

1. Technical Field

The present invention relates to circuit devices, electro-optical apparatuses, electronic instruments, and the like.

2. Related Art

Display panels having a so-called dual-gate structure are known as a kind of display panels used in active matrix display apparatuses (e.g. JP-A-10-73843 and JP-A-10-142578). Display panels having a dual-gate structure are panels having a structure in which one data line is shared by a pixel selected by a first scan line and a pixel selected by a second scan line.

A conventional technique described in JP-A-10-73843 solves a problem of vertical lines that appear on a display screen in the case of performing dot inversion driving in a display panel having a dual-gate structure, by devising a panel structure. Specifically, the problem of the vertical line is solved by devising a configuration of connection of the first scan line and the second scan line to odd-numbered pixels and even-numbered pixels. JP-A-10-142578 discloses a display panel having a dual-gate structure in which the configuration of connection of the first scan line and the second scan line to odd-numbered pixels and even-numbered pixels is different from that in JP-A-10-73843.

This kind of display panel having a dual-gate structure, which is able to halve the number of data lines, is advantageous in that a reduction in the size of the apparatus and a reduction in costs can be achieved.

However, in a display panel having a dual-gate structure, two pixels connected to one data line are selected in a time-division manner by the first scan line and the second scan line. For this reason, in the case of performing dot inversion driving, holding voltages at the pixels are adversely affected by parasitic capacitance between these pixels or the like. For example, vertical lines appear on a displayed image, resulting in a decrease in display quality.

In addition, the most suitable polarity inversion pattern differs depending on the type of display panel in some cases, and an achievement of a circuit device capable of providing the most suitable polarity inversion patterns corresponding to various types of display panels with simple settings is desired.

SUMMARY

According to some aspects of the invention, a circuit device capable of improving display quality in a display panel having a dual-gate structure, an electro-optical apparatus, an electronic instrument, and the like can be provided.

An aspect of the invention relates to a circuit device for driving a display panel that has a first pixel group selected by a first scan line, and a second pixel group selected by the second scan line, the first scan line and the second scan line being provided in correspondence with a first display line, and in which each of a plurality of data lines is shared by one pixel in the first pixel group and one pixel in the second pixel group, the circuit device including: a driving unit that drives the display panel based on display data; a control unit that controls the driving unit; and a polarity setting unit. In a first scanning period in which the first pixel group is selected by the first scan line, the driving unit outputs a data voltage with a first polarity, which is one of a positive polarity and a negative polarity, to a first data line in the plurality of data lines, and outputs a data voltage with a second polarity, which is a polarity opposite to the first polarity, to a second data line in the plurality of data lines. In a second scanning period in which the second pixel group is selected by the second scan line, the driving unit outputs a data voltage with a third polarity, which is one of a positive polarity and a negative polarity, to the first data line, and outputs a data voltage with a fourth polarity, which is a polarity opposite to the third polarity, to the second data line. The polarity setting unit sets the first polarity, the second polarity, the third polarity, and the fourth polarity.

According to an aspect of the invention, in the first scanning period, the data voltages with the first polarity and the second polarity are output respectively to the first data line and the second data line. In the second scanning period, a data voltage with the third polarity and a data voltage with the fourth polarity are output respectively thereto. The first polarity, the second polarity, the third polarity, and the fourth polarity are set by the polarity setting unit. The first polarity, the second polarity, the third polarity, and the fourth polarity can thereby be set to various polarities, and data voltages with a variety of polarity patterns can be output. This configuration enables the most suitable polarity patterns to be selected for various display panels, and enables display quality to be improved in a display panel having a dual-gate structure.

According to an aspect of the invention, the driving unit may include a driving circuit provided in correspondence with the first data line and the second data line, and the driving circuit may include: a positive-polarity amplifier circuit that outputs a positive voltage; a negative-polarity amplifier circuit that outputs a negative voltage; a first switching circuit that outputs, to the first data line, an output voltage from one of the positive-polarity amplifier circuit and the negative-polarity amplifier circuit, and a second switching circuit that outputs, to the second data line, an output voltage from the other one of the positive-polarity amplifier circuit and the negative-polarity amplifier circuit, the other one being different from the one of the positive-polarity amplifier circuit and the negative-polarity amplifier circuit.

With this configuration, one of a positive voltage and a negative voltage is output to the first data line, and the other one is output to the second data line. Data voltages with opposite polarities can thereby be output to the first data line and the second data line. One pair of the positive-polarity amplifier circuit and the negative-polarity amplifier circuit need only be provided for the first data line and the second data line. Accordingly, the scale of the circuit can be reduced.

Another aspect of the invention relates to a circuit device for driving a display panel that has a first pixel group selected by a first scan line, and a second pixel group selected by the second scan line, the first scan line and the second scan line being provided in correspondence with a first display line, and in which each of a plurality of data lines is shared by one pixel in the first pixel group and one pixel in the second pixel group, the circuit device including: a driving unit that drives the display panel based on display data. In a first scanning period in which the first pixel group is selected by the first scan line, the driving unit outputs a data voltage with a first polarity, which is one of a positive polarity and a negative polarity, to a first data line in the plurality of data lines, and outputs a data voltage with a second polarity, which is a polarity opposite to the first polarity, to a second data line in the plurality of data lines.

In a second scanning period in which the second pixel group is selected by the second scan line, the driving unit outputs a data voltage with a third polarity, which is one of a positive polarity and a negative polarity, to the first data line, and outputs a data voltage with a fourth polarity, which is a polarity opposite to the third polarity, to the second data line. The driving unit includes a driving circuit provided in correspondence with the data line and the second data line. The driving circuit includes: a positive-polarity amplifier circuit that outputs a positive voltage; a negative-polarity amplifier circuit that outputs a negative voltage; a first switching circuit that outputs, to the first data line, an output voltage from one of the positive-polarity amplifier circuit and the negative-polarity amplifier circuit, and a second switching circuit that outputs, to the second data line, an output voltage from the other one of the positive-polarity amplifier circuit and the negative-polarity amplifier circuit, the other one being different from the one of the positive-polarity amplifier circuit and the negative-polarity amplifier circuit.

According to another aspect of the invention, in the first scanning period, the data voltages with the first polarity and the second polarity are output respectively to the first data line and the second data line. In the second scanning period, a data voltage with the third polarity and a data voltage with the fourth polarity are output respectively thereto. One of a positive voltage and a negative voltage is output to the first data line, and the other one is output to the second data line. The first polarity and the second polarity are opposite polarities, and the third polarity and the fourth polarity are opposite polarities. By appropriately setting the first polarity, the second polarity, the third polarity, and the fourth polarity, display quality can be improved in a display panel having a dual-gate structure. One pair of the positive-polarity amplifier circuit and the negative-polarity amplifier circuit need only be provided for the first data line and the second data line. Accordingly, the scale of the circuit can be reduced.

In some aspects of the invention, in the first scanning period, the first switching circuit may output a data voltage with the first polarity from the one of the positive-polarity amplifier circuit and the negative-polarity amplifier circuit to the first data line, and the second switching circuit may output a data voltage with the second polarity from the other one of the positive-polarity amplifier circuit and the negative-polarity amplifier circuit to the second data line. In the second scanning period, the first switching circuit may output a data voltage with the third polarity from the one of the positive-polarity amplifier circuit and the negative-polarity amplifier circuit to the first data line, and the second switching circuit may output a data voltage with the fourth polarity from the other one of the positive-polarity amplifier circuit and the negative-polarity amplifier circuit to the second data line.

With such operation of the first switching circuit and the second switching circuit, data voltages with various polarities can be output as the data voltages with the first polarity, the second polarity, the third polarity, and the fourth polarity. It is also possible to output data voltages with opposite polarities as the data voltages with the first polarity and the second polarity, and output data voltages with opposite polarities as the data voltages with the third polarity and the fourth polarity.

In some aspects of the invention, the driving unit may include: a positive-polarity D/A conversion circuit provided on an upstream side of the positive-polarity amplifier circuit; and a negative-polarity D/A conversion circuit provided on an upstream side of the negative-polarity amplifier circuit.

This configuration enables an output voltage of the positive-polarity D/A conversion circuit (or a voltage based thereon) to be input to the positive-polarity amplifier circuit, and enables an output voltage of the negative-polarity D/A conversion circuit (or a voltage based thereon) to be input to the negative-polarity amplifier circuit. One pair of the positive-polarity D/A conversion circuit and the negative-polarity D/A conversion circuit need only be provided for the first data line and the second data line. Accordingly, it is possible to reduce the number of D/A conversion circuits and reduce the scale of the circuit.

In some aspects of the invention, the driving unit may include: a positive-polarity gray level voltage generation circuit that supplies a plurality of positive-polarity gray level voltages to the positive-polarity D/A conversion circuit; and a negative-polarity gray level voltage generation circuit that supplies a plurality of negative-polarity gray level voltages to the negative-polarity D/A conversion circuit.

With this configuration, the positive-polarity D/A conversion circuit can select a positive-polarity gray level voltage corresponding to display data from among the plurality of positive-polarity gray level voltages supplied from the positive-polarity gray level voltage generation circuit, and output the selected positive-polarity gray level voltage to the positive-polarity amplifier circuit. Also, the negative-polarity D/A conversion circuit can select a negative-polarity gray level voltage corresponding to display data from among the plurality of negative-polarity gray level voltages supplied from the negative-polarity gray level voltage generation circuit, and output the selected negative-polarity gray level voltage to the negative-polarity amplifier circuit.

In some aspects of the invention, the first data line may be shared by a first pixel, which is a pixel in the first pixel group, and a second pixel, which is a pixel in the second pixel group, and the second data line may be shared by a third pixel, which is a pixel in the first pixel group, and a fourth pixel, which is a pixel in the second pixel group. In the first scanning period, the driving unit may output a data voltage with the first polarity for the first pixel to the first data line shared by the first pixel and the second pixel, and output a data voltage with the second polarity for the third pixel to the second data line shared by the third pixel and the fourth pixel. In the second scanning period, the driving unit may output a data voltage with the third polarity for the second pixel to the first data line, and output a data voltage with the fourth polarity for the fourth pixel to the second data line.

With this configuration, data voltages with the first polarity, the third polarity, the second polarity, and the fourth polarity are written respectively in the first pixel, the second pixel, the third pixel, and the fourth pixel on the first display line that is provided in correspondence with the first scan line and the second scan line. Thus, data voltages can be written in the respective pixels in accordance with the first polarity, the second polarity, the third polarity, and the fourth polarity that are set as various polarity patterns by the polarity setting unit.

In some aspects of the invention, the display panel may have a third pixel group selected by a third scan line, and a fourth pixel group selected by the fourth scan line, the third scan line and the fourth scan line being provided in correspondence with a second display line, and each of the plurality of data lines is shared by one pixel in the third pixel group and one pixel in the fourth pixel group. In the first scanning period in which the first pixel group is selected by the first scan line, the driving unit may output a positive data voltage to the first data line, and output a negative data voltage to the second data line. In the second scanning period in which the second pixel group is selected by the second scan line, the driving unit may output a positive data voltage to the first data line, and output a negative data voltage to the second data line. In a third scanning period in which the third pixel group is selected by the third scan line, the driving unit may output a negative data voltage to the first data line, and output a positive data voltage to the second data line. In a fourth scanning period in which the fourth pixel group is selected by the fourth scan line, the driving unit may output a positive data voltage to the first data line, and output a negative data voltage to the second data line.

With this configuration, the boundaries between pixels in which data voltages with opposite polarities are written can be set between pixels that do not share a data line in the first pixel group and the second pixel group that are selected respectively by the first scan line and the second scan line. On the other hand, in the third pixel group and the fourth pixel group that are selected respectively by the third scan line and the fourth scan line, this boundaries can be set between pixels that share a data line. Accordingly, the positions of the boundaries between pixels in which data voltages with opposite polarities are written can be shifted in a column direction. It is thereby possible to suppress the occurrence of vertical lines in every two columns that is unique to display panels having a dual-gate structure, and to achieve improvement in display quality and the like.

Yet another aspect of the invention relates to a circuit device for driving a display panel that has a first pixel group selected by a first scan line, a second pixel group selected by the second scan line, the first scan line and the second scan line being provided in correspondence with a first display line, a third pixel group selected by a third scan line, and a fourth pixel group selected by the fourth scan line, the third scan line and the fourth scan line being provided in correspondence with a second display line, and in which each of a plurality of data lines is shared by one pixel in the first pixel group and one pixel in the second pixel group, and is shared by one pixel in the third pixel group and one pixel in the fourth pixel group, the circuit device including: a driving unit that drives the display panel based on display data; and a control unit that controls the driving unit. In a first scanning period in which the first pixel group is selected by the first scan line, the driving unit outputs a positive data voltage to a first data line, and outputs a negative data voltage to a second data line. In a second scanning period in which the second pixel group is selected by the second scan line, the driving unit outputs a positive data voltage to the first data line, and outputs a negative data voltage to the second data line. In a third scanning period in which the third pixel group is selected by the third scan line, the driving unit outputs a negative data voltage to the first data line, and outputs a positive data voltage to the second data line. In a fourth scanning period in which the fourth pixel group is selected by the fourth scan line, the driving unit outputs a positive data voltage to the first data line, and outputs a negative data voltage to the second data line.

According to yet another aspect of the invention, similar to the above, the positions of the boundaries between pixels in which data voltages with opposite polarities are written can be shifted in the column direction. It is thereby possible to suppress the occurrence of vertical lines in every two columns that is unique to display panels having a dual-gate structure, and to achieve improvement in display quality and the like.

In some aspects of the invention, the first data line may be shared by a first pixel, which is a pixel in the first pixel group, and a second pixel, which is a pixel in the second pixel group, the second data line may be shared by a third pixel, which is a pixel in the first pixel group, and a fourth pixel, which is a pixel in the second pixel group, the first data line is shared by a fifth pixel, which is a pixel in the third pixel group, and a sixth pixel, which is a pixel in the fourth pixel group, and the second data line is shared by a seventh pixel, which is a pixel in the third pixel group, and an eighth pixel, which is a pixel in the fourth pixel group. In the first scanning period, the driving unit may output a positive data voltage for the first pixel to the first data line, and output a negative data voltage for the third pixel to the second data line. In the second scanning period, the driving unit may output a positive data voltage for the second pixel to the first data line, and output a negative data voltage for the fourth pixel to the second data line. In the third scanning period, the driving unit may output a negative data voltage for the fifth pixel to the first data line, and output a positive data voltage for the seventh pixel to the second data line. In the fourth scanning period, the driving unit may output a positive data voltage for the sixth pixel to the first data line, and output a negative data voltage for the eighth pixel to the second data line.

With this configuration, a positive data voltage, a positive data voltage, a negative data voltage, and a negative data voltage are written respectively in the first pixel, the second pixel, the third pixel, and the fourth pixel on the first display line. A negative data voltage, a positive data voltage, a positive data voltage, and a negative data voltage are written respectively in the fifth pixel, the sixth pixel, the seventh pixel, and the eighth pixel on the second display line. That is to say, the boundaries between pixels in which data voltages with opposite polarities are written are located between the second pixel and the third pixel on the first display line, and between the fifth pixel and the sixth pixel and between the seventh pixel and the eighth pixel on the second display line. Thus, the boundaries are shifted in the column direction.

In some aspects of the invention, the display panel may have a fifth pixel group selected by a fifth scan line, a sixth pixel group selected by the sixth scan line, the fifth scan line and the sixth scan line being provided in correspondence with a third display line, a seventh pixel group selected by a seventh scan line, and an eighth pixel group selected by the eighth scan line, the seventh scan line and the eighth scan line being provided in correspondence with a fourth display line, and in the display panel, each of the plurality of data lines is shared by one pixel in the fifth pixel group and one pixel in the sixth pixel group, and is shared by one pixel in the seventh pixel group and one pixel in the eighth pixel group. In a fifth scanning period in which the fifth pixel group is selected by the fifth scan line, the driving unit may output a negative data voltage to the first data line, and output a positive data voltage to the second data line. In a sixth scanning period in which the sixth pixel group is selected by the sixth scan line, the driving unit may output a negative data voltage to the first data line, and output a positive data voltage to the second data line. In a seventh scanning period in which the seventh pixel group is selected by the seventh scan line, the driving unit may output a positive data voltage to the first data line, and output a negative data voltage to the second data line. In an eighth scanning period in which the eighth pixel group is selected by the eighth scan line, the driving unit may output a negative data voltage to the first data line, and output a positive data voltage to the second data line.

With this configuration, the boundaries between pixels in which data voltages with opposite polarities are written can be set between pixels that do not share a data line in the fifth pixel group and the sixth pixel group that are selected respectively by the fifth scan line and the sixth scan line. On the other hand, in the seventh pixel group and the eighth pixel group that are selected respectively by the seventh scan line and the eighth scan line, the boundaries can be set between pixels that share a data line. Accordingly, the positions of the boundaries between pixels in which data voltages with opposite polarities are written can be shifted in the column direction. It is thereby possible to suppress the occurrence of vertical lines in every two columns that is unique to display panels having a dual-gate structure, and to achieve improvement in display quality and the like.

In some aspects of the invention, the first data line may be shared by a ninth pixel, which is a pixel in the fifth pixel group, and a tenth pixel, which is a pixel in the sixth pixel group, the second data line may be shared by an eleventh pixel, which is a pixel in the fifth pixel group, and a twelfth pixel, which is a pixel in the sixth pixel group, the first data line may be shared by a thirteenth pixel, which is a pixel in the seventh pixel group, and a fourteenth pixel, which is a pixel in the eighth pixel group, and the second data line may be shared by a fifteenth pixel, which is a pixel in the seventh pixel group, and a sixteenth pixel, which is a pixel in the eighth pixel group. In the fifth scanning period, the driving unit may output a negative data voltage for the ninth pixel to the first data line shared by the ninth pixel and the tenth pixel, and output a positive data voltage for the eleventh pixel to the second data line shared by the eleventh pixel and the twelfth pixel. In the sixth scanning period, the driving unit may output a negative data voltage for the tenth pixel to the first data line, and output a positive data voltage for the twelfth pixel to the second data line. In the seventh scanning period, the driving unit may output a positive data voltage for the thirteenth pixel to the first data line shared by the thirteenth pixel and the fourteenth pixel, and output a negative data voltage for the fifteenth pixel to the second data line shared by the fifteenth pixel and the sixteenth pixel. In the eighth scanning period, the driving unit may output a negative data voltage for the fourteenth pixel to the first data line, and output a positive data voltage for the sixteenth pixel to the second data line.

With this configuration, a negative data voltage, a negative data voltage, a positive data voltage, and a positive data voltage are written respectively in the ninth pixel, the tenth pixel, the eleventh pixel, and the twelfth pixel on the third display line. A positive data voltage, a negative data voltage, a negative data voltage, and a positive data voltage are written respectively in the thirteenth pixel, the fourteenth pixel, the fifteenth pixel, and the sixteenth pixel on the fourth display line. That is to say, the boundaries between pixels in which data voltages with opposite polarities are written are located between the tenth pixel and the eleventh pixel on the third display line, and between the thirteenth pixel and the fourteenth pixel and between the fifteenth pixel and the sixteenth pixel on the fourth display line. Thus, the boundaries are shifted in the column direction.

Yet another aspect of the invention relates to an electro-optical apparatus that includes any one of the above-described circuit devices, and the display panel.

Yet another aspect of the invention relates to an electronic instrument that includes any one of the above-described circuit devices.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a preferable embodiment of the invention will be described in detail. Note that the embodiment described below does not intend to unduly limit the content of the invention described in the patent claims, and not all configurations described in this embodiment are necessarily essential for solving means of the invention.

1. Circuit Device

Figure 1:
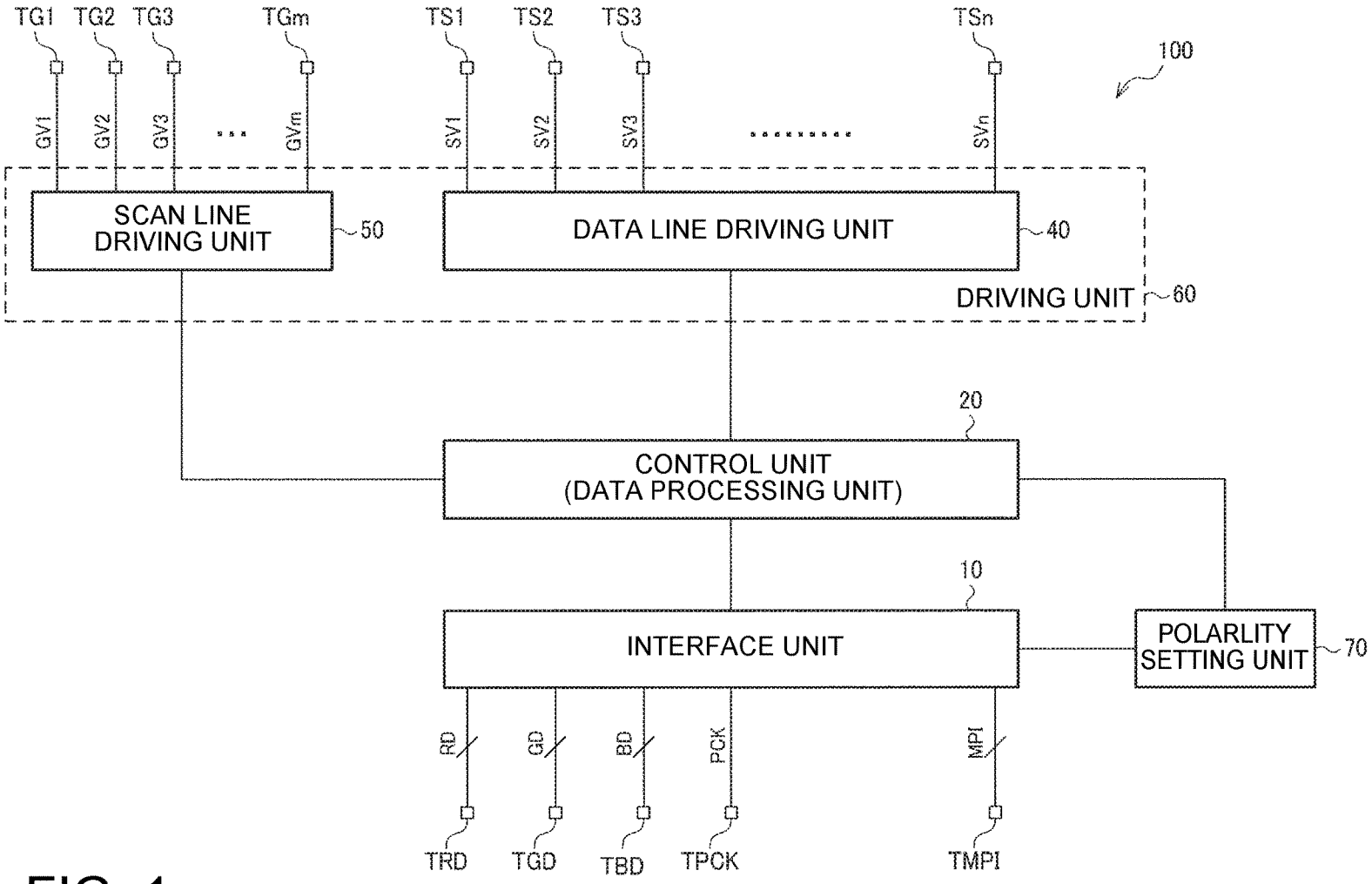
FIG. 1 shows an exemplary configuration of a circuit device according to an embodiment.

FIG. 1 shows an exemplary configuration of a circuit device 100 (a display driver) according to this embodiment. The circuit device 100 includes an interface unit 10 (an interface circuit), a control unit 20 (a control circuit; a data processing unit), a driving unit 60 (a driving circuit), a polarity setting unit 70 (a polarity setting circuit; a polarity pattern setting unit), a first color component input terminal TRD, a second color component input terminal TGD, a third color component input terminal TBD, a clock input terminal TPCK, an interface terminal TMPI, data line driving terminal TS1 to TSn (n is an integer greater than or equal to 2) and scan line driving terminals TG1 to TGm (gate line driving terminals; m is an integer greater than or equal to 2). The driving unit 60 includes a data line driving unit 40 (a data line driving circuit) and a scan line driving unit 50 (a gate line driving unit; scan line driving circuit). The circuit device 100 is achieved by an integrated circuit device (IC) or the like, for example.

The interface unit 10 communicates with an external processing device (a display controller such as an MPU, a CPU, or an ASIC). Communication refers to the transfer of image data, the supply of a clock signal and a synchronizing signal, the transfer of a command (or a control signal), or the like, for example. The interface unit 10 is constituted by an I/O buffer or the like, for example.

The control unit 20 performs image data processing, timing control, control of each part of the circuit device 100, and the like based on image data, a clock signal, a synchronizing signal, a command, and the like that are input via the interface unit 10. In the image data processing, for example, data copy and data replacement between color component channels, image processing (e.g. gray level correction), and the like are performed. In the timing control, the timing (selection timing) of driving scan lines (gate lines) and the timing of driving data lines in a display panel are controlled based on the synchronizing signal and the image data. The polarity of a data voltage that is to be written in each pixel is controlled based on a driving polarity for each pixel that is set by the polarity setting unit 70. The control unit 20 is constituted by a logic circuit such as a gate array, for example.

The data line driving unit 40 includes a gray level voltage generation circuit and a plurality of driving circuits. Each driving circuit includes a D/A conversion circuit and an amplifier circuit. The gray level voltage generation circuit outputs a plurality of voltages, and each of these voltages corresponds to one of a plurality of gray level values. The D/A conversion circuit selects a voltage corresponding to image data from among the plurality of voltages from the gray level voltage generation circuit. The amplifier circuit outputs a data voltage based on a data voltage from the D/A conversion circuit. Data voltages SV1 to SVn are thus output to the data line driving terminals TS1 to TSn by the plurality of driving circuits, and data lines in the display panel are driven. As described later, each driving circuit is provided in correspondence with two data lines, and performs dot inversion driving by driving these two data lines with opposite polarities. The gray level voltage generation circuit is constituted by a ladder resistor or the like, for example. The D/A conversion circuit is constituted by a switching circuit or the like, for example. The amplifier circuit is constituted by an operational amplifier, a capacitor, or the like, for example.

The scan line driving unit 50 outputs scan line driving voltages GV1 to GVm to the scan line driving terminals TG1 to TGm, and drives (selects) a scan line in the display panel. In this embodiment, the circuit device 100 is a display driver that drives a dual-gate display panel, and the scan line driving unit 50 selects two scan lines during one horizontal scanning period in a time-division manner. The scan line driving unit 50 is constituted by a plurality of voltage output circuits (buffers and amplifiers), for example, and one voltage output circuit is provided in correspondence with each scan line driving terminal, for example.

Polarity patterns (polarity inversion patterns) are set in the polarity setting unit 70, and the polarity setting unit 70 sets a driving polarity for each pixel in the display panel based on these polarity patterns. The polarity patterns are patterns in which driving using a data voltage with one of a positive polarity and a negative polarity is assigned to each pixel in the display panel. For example, the polarity setting unit 70 includes an instruction information storage unit in which instruction information for giving an instruction regarding which polarity pattern to use is stored, and a polarity information output unit that outputs, to the control unit 20, information regarding a driving polarity for each pixel based on the polarity pattern corresponding to this instruction information. For example, the instruction information storage unit is a register. An external processing device outputs a polarity pattern setting command by means of an interface signal MPI, and the interface unit 10 writes polarity pattern instruction information in the register based on this command. Alternatively, the instruction information storage unit may be a nonvolatile memory or a fuse. In this case, the polarity pattern instruction information is written in the nonvolatile memory or the fuse at the time of manufacturing the circuit device 100, for example. The polarity information output unit may be a storage unit in which information regarding a driving polarity for each pixel in each polarity pattern is stored, or may be a logic circuit that generates information regarding a driving polarity for each pixel in each polarity pattern, for example.

Note that a configuration may be employed in which instruction information for giving an instruction regarding which of the polarity patterns to use is stored in the polarity setting unit 70, and the control unit 20 controls the driving polarity for each pixel using the polarity pattern corresponding to the instruction information from the polarity setting unit 70, based on this instruction information.

Figure 2:
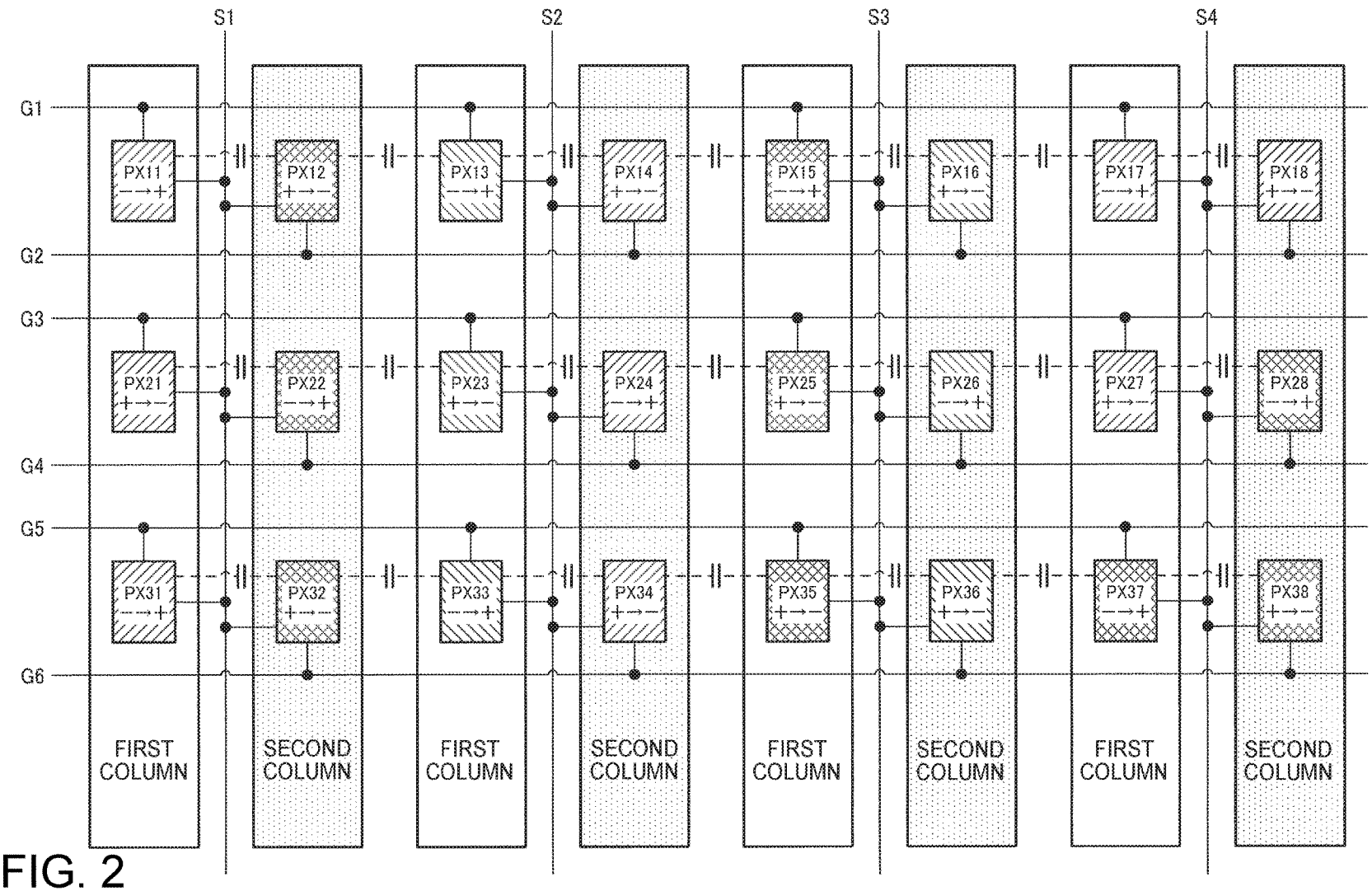
FIG. 2 is an exemplary polarity pattern in a comparative example in an embodiment.
Figure 3:
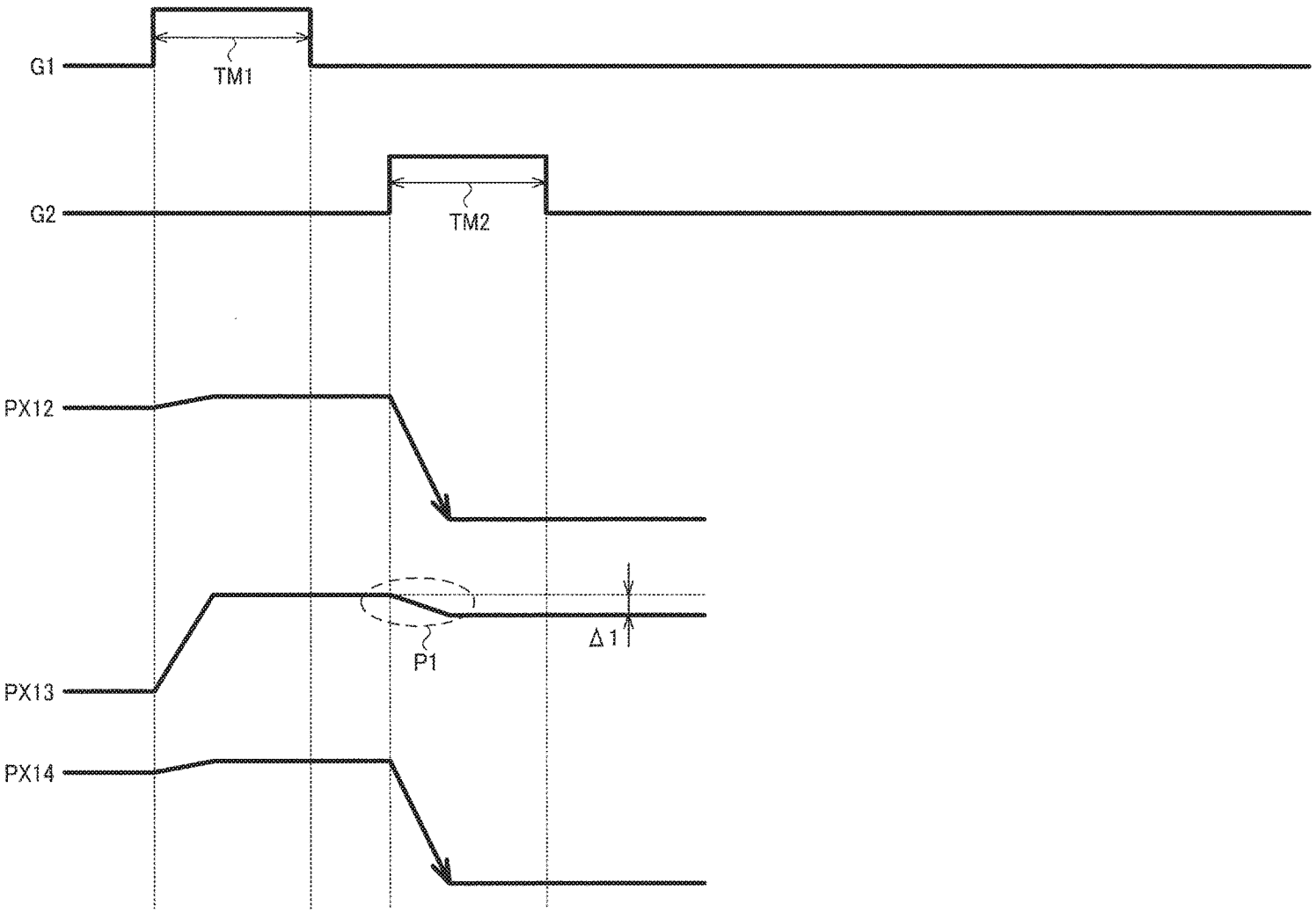
FIG. 3 is a waveform diagram relating to writing in pixels in the polarity pattern in the comparative example.

FIG. 2 shows an exemplary polarity pattern in the case where a display panel having a dual-gate structure has been subjected to dot inversion driving in a comparative example in this embodiment. FIG. 3 shows exemplary waveforms in the case of driving using the polarity pattern in FIG. 2. Note that, in a pixel array in the display panel in FIG. 2, for example, a pixel in a first row of a second column is denoted by a sign PX12. "Row" refers to a line extending in a horizontal scan direction (i.e. a direction along the scan lines), and "Column" refers to a line extending in a vertical scan direction (i.e. a direction along the data lines).

The polarity pattern in FIG. 2 is a polarity pattern for dot inversion driving. Pixels that are adjacent to each other in the horizontal scan direction and the vertical scan direction are driven with opposite polarities. Regarding signs "−→+" and "+→−" denoted on each pixel, "−→+" indicates that the pixel is driven with a negative polarity in a first frame and is driven with a positive polarity in the next second frame, whereas "+→−" indicates that the pixel is driven with a positive polarity in the first frame and is drive with a negative polarity in the second frame.

In the display panel in FIG. 2, two columns of pixels are connected to one data line, and are denoted as a first column (odd-numbered column) and a second column (even-numbered column). The pixels in the first column are connected to odd-numbered scan lines G1, G3, and G5, and the pixels in the second column are connected to even-numbered scan lines G2, G4, and G6. In a first horizontal scanning period, initially, pixels PX11, PX13, PX15, and PX17 in first columns are selected by the scan line G1 and data voltages are written therein, and next, pixels PX12, PX14, PX16, and PX18 in second columns are selected by the scan line G2 and data voltages are written therein. Similarly, in second and third horizontal scanning periods as well, pixels in the first columns are driven first, and next, pixels in the second columns are driven.

In the case of performing such driving, a problem arises in that an error may occur in holding voltages at pixels in the first columns, causing vertical lines to appear in a displayed image. This point will be described, taking the pixels PX12, PX13, and PX14 as an example.

FIG. 3 is a waveform diagram relating to writing in the pixels PX12, PX13, and PX14 in the second frame. In the first frame, the pixels PX12, PX13, and PX14 are driven respectively with a positive polarity, a negative polarity, and a positive polarity. Therefore, before the writing in the second frame, the holding voltages at the pixels PX12, PX13, and PX14 respectively have a positive polarity, a negative polarity, and a positive polarity. In a period TM1 (a first scanning period) in which the scan line G1 selects the pixel PX13 in the first column, a positive data voltage is written in the pixel PX13 that has held a negative data voltage. Next, in a period TM2 (a second scanning period) in which the scan line G2 selects the pixels PX12 and PX14 in the second columns, a negative data voltage is written in the pixels PX12 and PX14 that have held a positive data voltage. At this time, as indicated by P1, a voltage change at the pixels PX12 and PX14 in the second columns changes the holding voltage at the pixel PX13 in the first column via parasitic capacitance between the pixels. In the example in FIG. 3, the voltages at the pixels PX12 and PX14 in the second columns change from a positive polarity to a negative polarity. Therefore, a negative voltage error Δ1 occurs in the holding voltage at the pixel PX13 in the first column. Note that if the voltages at the pixels PX12 and PX14 in the second columns change from a negative polarity to a positive polarity, a positive voltage error occurs in the holding voltage at the pixel PX13 in the first column.

Since an error thus occurs in the holding voltage at a pixel in the first column, in the display panel in FIG. 2, a column in which a holding voltage error exists and a column in which a holding voltage error does not exist are located alternately, which appear to be vertical lines on a displayed image.

For example, FIG. 2 shows a color display panel, in which a column of R pixels, a column of G pixels, and a column of B pixels are arranged repeatedly. At this time, three columns, namely a column of R pixels, a column of G pixels, and a column of B pixels, are repeated as a set, and holding voltage errors occur in every two columns. Therefore, a situation may occur in which, a holding voltage error exists in the columns of R and B pixels in a certain RGB set, and a holding voltage error occurs in the column of G pixels in another set. For example, the set of the pixels PX11, PX12, and PX13 and the set of the pixels PX14, PX15, and PX16 respectively include R, G, and B pixels. Among them, the pixels PX11, PX13, and PX15 are the pixels in the first column in which holding voltage errors exist. That is to say, holding voltage errors exist in R and B pixels in the set of the pixels PX11, PX12, and PX13, and a holding voltage error exists in the G pixel in the set of the pixels PX14, PX15, and PX16. Due to this difference, the change in color caused by the holding voltage errors differs depending on columns and appears to be vertical lines.

In other cases, in a monochrome display panel as well, a holding voltage error in pixels in the first columns directly causes a gray level error to appear, and therefore appears to be vertical lines in every two columns.

In order to suppress such a decrease in display quality, devising the polarity pattern in polarity inversion driving is conceivable. However, there are cases where the most suitable polarity pattern differs depending on the type of display panel.

For example, regarding display panels having a dual-gate structure, connection relationship between scan lines and pixels is not limited to the configuration in FIG. 2 (FIG. 14), and different configurations are conceivable. Although exemplary display panels with such different configurations will be described later using FIGS. 15 and 16, in these kinds of display panels, the arrangement order of pixels connected to odd-numbered scan lines and pixels connected to even-numbered scan lines is different in respective rows. Therefore, pixels in which holding voltage errors occur (i.e. pixels connected to odd-numbered scan lines) are not arranged in one column. For this reason, the most suitable polarity pattern differs depending on the type of dual-gate structure in some cases.

Alternatively, even in the case of the same type of dual-gate structure, for example, parasitic capacitance or the like differs depending on the model of display panel, and the situation regarding the occurrence of holding voltage errors also differs accordingly. For this reason, the most suitable polarity pattern differs depending on the model of display panel in some cases.

The circuit device 100 according to this embodiment is able to solve the above-described problem. This point will be described below.

The circuit device 100 according to this embodiment includes the driving unit 60 that drives the display panel based on display data, the control unit 20 that controls the driving unit 60, and the polarity setting unit 70.

For example, as shown in FIG. 2, the display panel has a first pixel group (PX11, PX13, PX15, and PX17) selected by the first scan line G1, of the first scan line G1 and the second scan line G2 that are provided in correspondence with a display line, and a second pixel group (PX12, PX14, PX16, and PX18) selected by the second scan line G2. In the display panel, each of a plurality of data lines (e.g. a data line S1) is shared by one pixel (PX11) in the first pixel group and one pixel (PX12) in the second pixel group.

Figure 10:
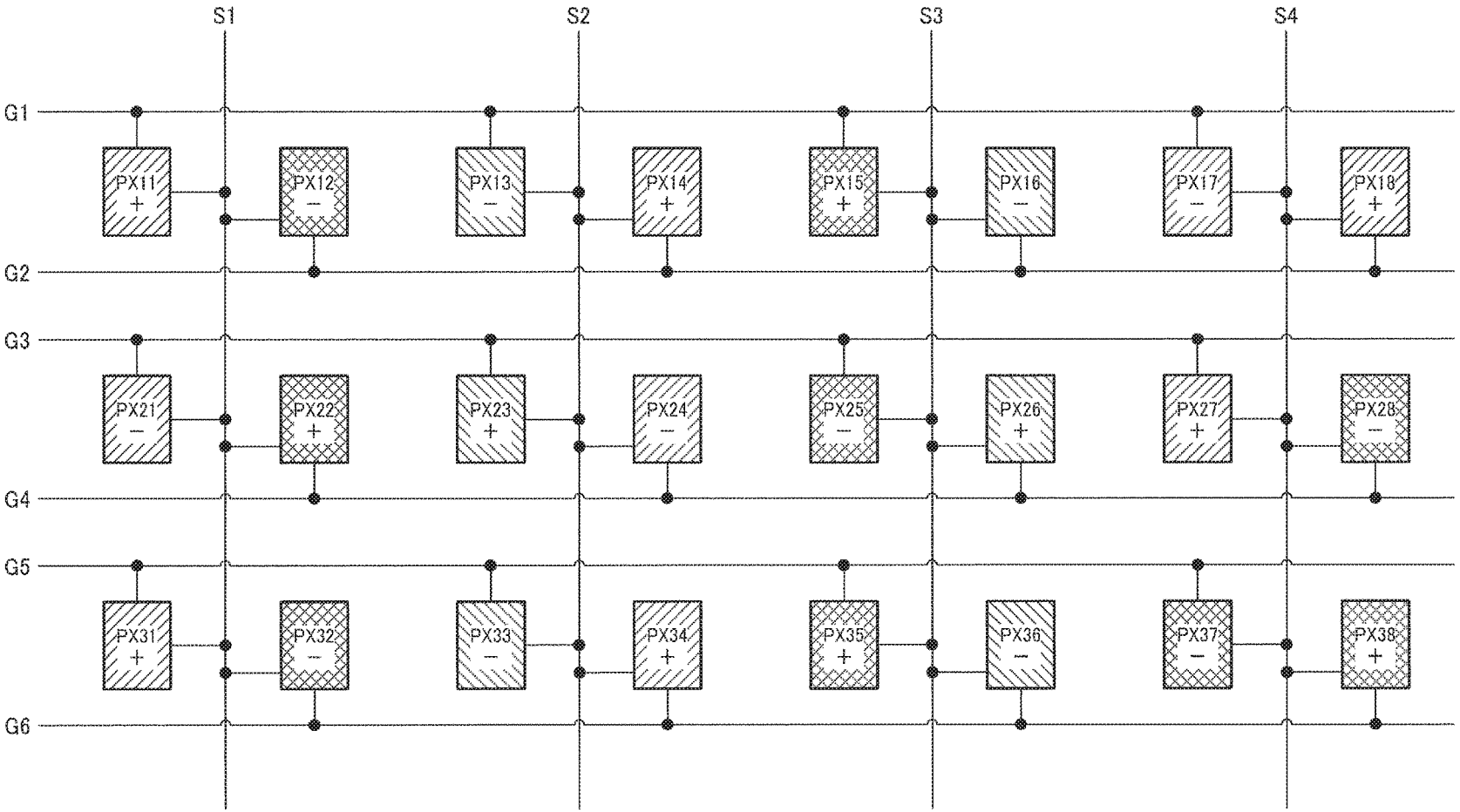
FIG. 10 shows a first polarity pattern.

As shown in FIG. 10 and other similar diagrams, in a first scanning period in which the first pixel group is selected by the first scan line G1, the driving unit 60 outputs a data voltage with a first polarity (a positive polarity in the example in FIG. 10), which is one of a positive polarity and a negative polarity, to the first data line S1 in the plurality of data lines, and outputs a data voltage with a second polarity (a negative polarity in the example in FIG. 10), which is a polarity opposite to the first polarity, to a second data line S2 that is adjacent to the first data line S1 in the plurality of data lines.

In a second scanning period in which the second pixel group is selected by the second scan line G2, the driving unit 60 outputs a data voltage with a third polarity (a negative polarity in the example in FIG. 10), which is one of a positive polarity and a negative polarity, to the first data line S1, and outputs a data voltage with a fourth polarity (a positive polarity in the example in FIG. 10), which is a polarity opposite to the third polarity, to the second data line S2.

The polarity setting unit 70 sets the aforementioned first polarity, second polarity, third polarity, and fourth polarity (i.e. sets a pattern of the first polarity, the second polarity, the third polarity, and the fourth polarity as a polarity inversion pattern).

According to this embodiment, in the first scanning period, the data voltages with the first polarity and the second polarity are output respectively to the first data line S1 and the second data line S2. In the second scanning period, the data voltages with the third polarity and the fourth polarity are output respectively to the first data line S1 and the second data line S2. The first polarity, the second polarity, the third polarity, and the fourth polarity are set by the polarity setting unit. The first polarity, the second polarity, the third polarity, and the fourth polarity can thereby be set to various polarities, and data voltages with a variety of polarity patterns can be output. The most suitable polarity inversion pattern corresponding to each of various types of display panels can thereby be provided with simple settings.

The first polarity for the first data line S1 and the second polarity for the second data line S2 in the first scanning period are opposite polarities, and the third polarity for the first data line S1 and the fourth polarity for the second data line S2 in the second scanning period are also opposite polarities. Accordingly, in each of the first and second scanning periods, a data voltage with the same polarity does not have to be output to the first data line S1 and the second data line S2. Accordingly, for example, a configuration in which a positive-polarity circuit (e.g. a positive-polarity amplifier) and a negative-polarity circuit (e.g. a negative-polarity amplifier) provided in the driving unit 60 are shared by the first data line S1 and the second data line S2 can be employed, and a reduction in the scale of the circuit of the driving unit 60, a reduction in power consumption, and the like can be achieved.

In addition, as a result of the polarity for the first data line S1 and the polarity for the second data line S2 being opposite polarities, two-dot inversion driving in which the polarity is inverted at every two dots on a display line is performed. Thus, there is a possibility that the occurrence of a holding voltage error in pixels in the first columns described using FIG. 2 can be reduced. This point will now be described using FIGS. 4 and 5.

Figure 4:
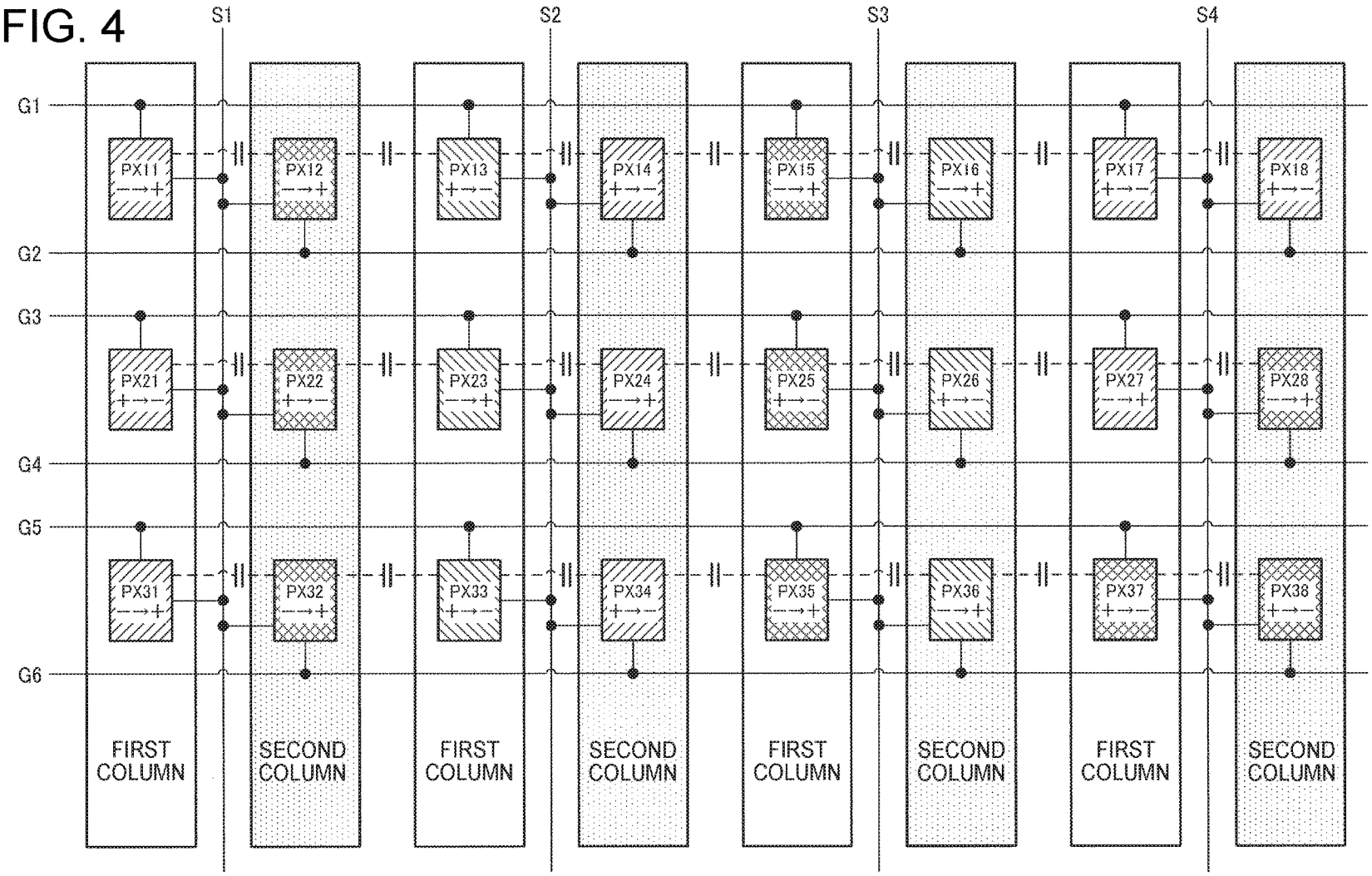
FIG. 4 is an exemplary polarity pattern according to an embodiment.

FIG. 4 shows an exemplary polarity pattern in two-dot inversion driving. As is understood from FIG. 4, in two-dot inversion driving, the polarities of pixels in the second columns on both sides of each pixel in the first columns are opposite polarities. For example, in the second frame, the polarities of the pixels PX12 and PX14 in the second columns on both sides of the pixel PX13 are a positive polarity and a negative polarity, respectively, and are opposite polarities.

Figure 5:
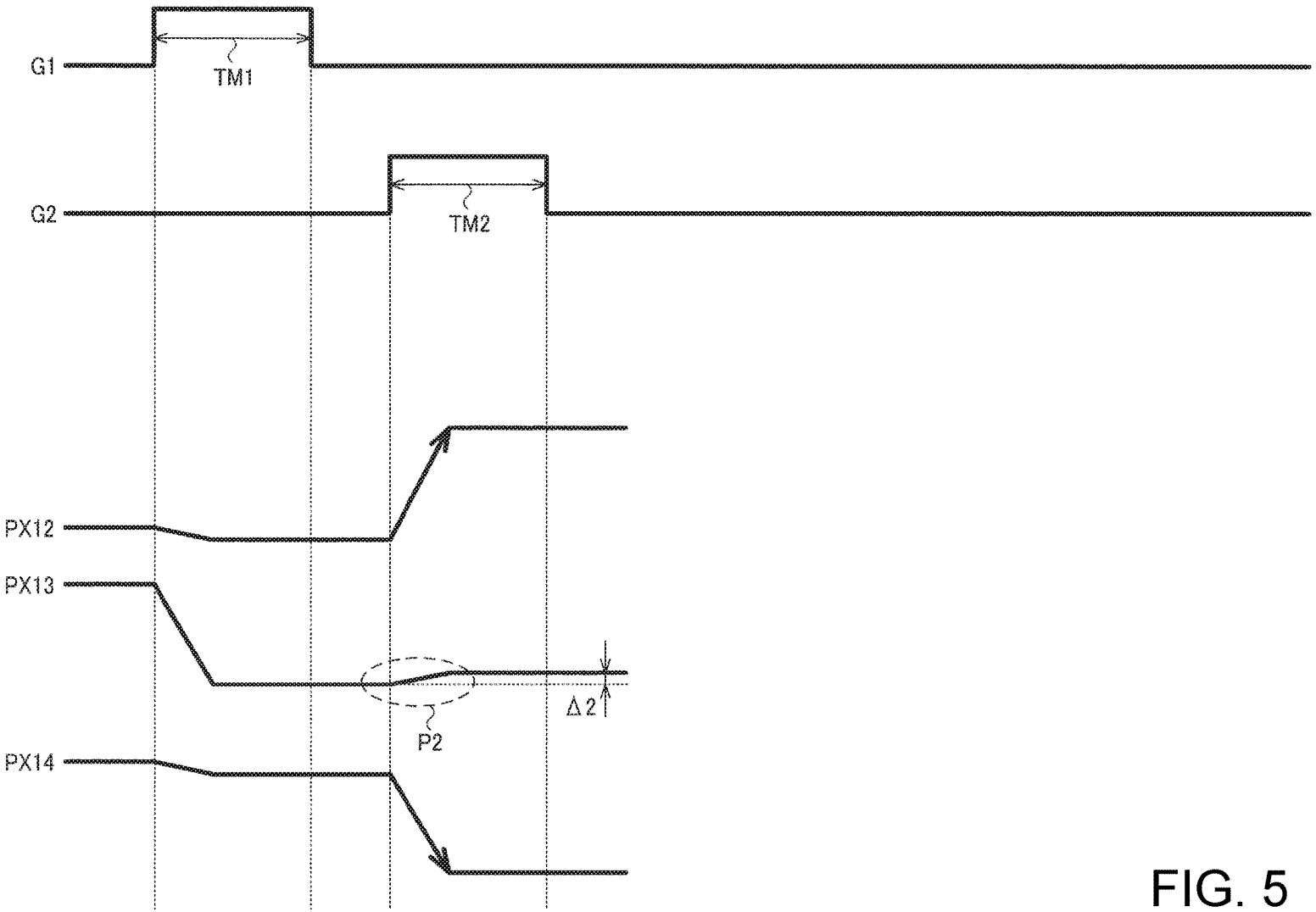
FIG. 5 is a waveform diagram relating to writing in a pixel in the polarity pattern according to an embodiment.

FIG. 5 shows a waveform diagram relating to writing in the pixels PX12, PX13, and PX14 in the second frame. In a period TM2 in which the scan line G2 selects the pixels PX12 and PX14 in the second columns, a positive data voltage and a negative data voltage are written respectively in the pixels PX12 and PX14 that have held a negative data voltage and a positive data voltage, respectively. At this time, as indicated by P2, the holding voltage at the pixel PX13 in the first column is changed. However, the polarities of the adjacent pixels PX12 and PX14 change to opposite polarities. Therefore, there is a possibility that the influences of their polarity changes exerted via parasitic capacitance offset each other, and an error Δ2 in the holding voltage becomes smaller than the error Δ1 in FIG. 3. As a result of a decrease in the error Δ2 in the holding voltage, the display quality can be improved.

Note that although the above description has been given while taking the display panel in FIG. 2 (FIG. 14) as an example, the invention is not limited thereto. For example, display panels having various dual-gate structures, such as those shown in FIGS. 15 and 16, can be employed. At this time, pixels that belong to the first pixel group and the second pixel group change in accordance with the connection relationship between scan lines and pixels in respective dual-gate structures. Also, although the above description has been given while taking the polarity pattern in FIG. 4 (FIG. 11) as an example, the invention is not limited thereto. For example, various polarity patterns such as those shown in FIGS. 10, 12, and 13 can be employed. The first polarity, which is one of a positive polarity and a negative polarity, and the third polarity, which is one of a positive polarity and a negative polarity, may be the same polarity, or may be different, opposite polarities.

Figure 6:
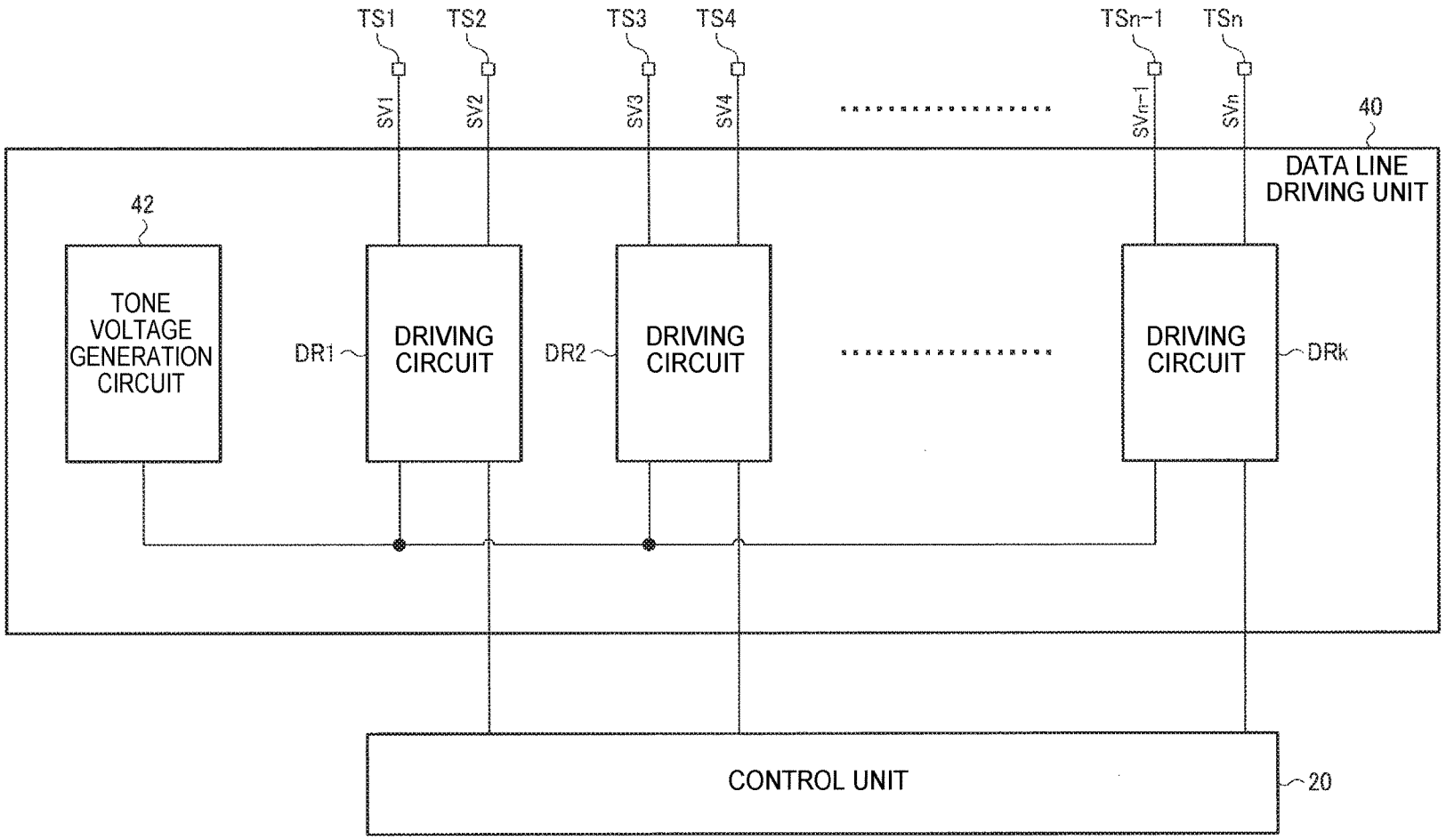
FIG. 6 is an exemplary detailed configuration of a data line driving unit.
Figure 7:
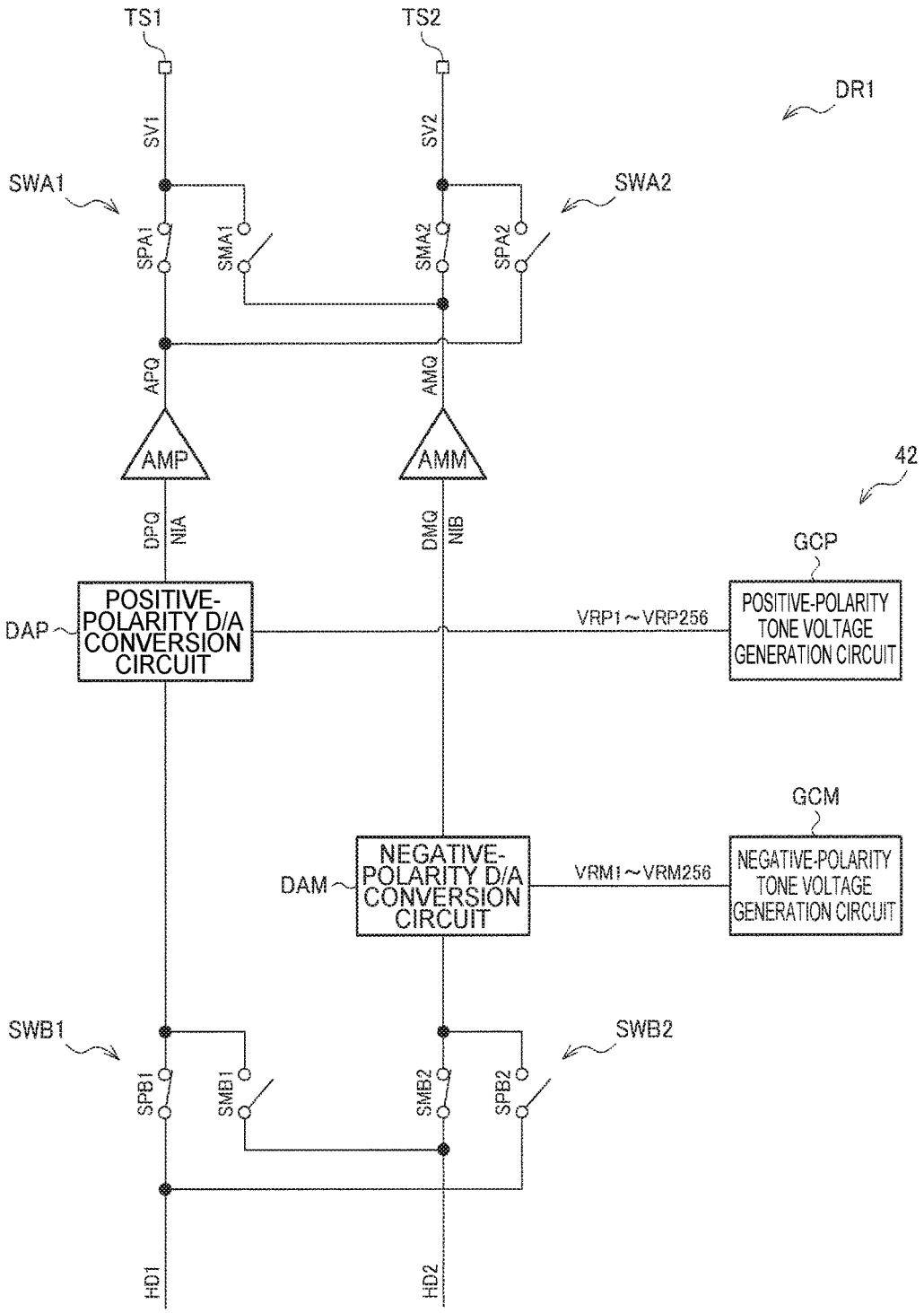
FIG. 7 is an exemplary detailed configuration of a driving circuit.

In this embodiment, as shown in FIG. 6, the driving unit 60 includes a driving circuit DR1, which is provided in correspondence with the first data line S1 and the second data line S2. As shown in FIG. 7, the driving circuit DR1 includes a positive-polarity amplifier circuit AMP that outputs a positive voltage, a negative-polarity amplifier circuit AMM that outputs a negative voltage, a first switching circuit SWA1 that outputs, to the first data line S1, an output voltage from one of the positive-polarity amplifier circuit AMP and the negative-polarity amplifier circuit AMM, and a second switching circuit SWA2 that outputs, to the second data line S2, an output voltage from the other one of the amplifier circuits, the other one being different from the one of the amplifier circuits.

With this configuration, one of a positive voltage or a negative voltage is output to the first data line S1, and the other one is output to the second data line S2. Data voltages with opposite polarities can thereby be output to the first data line S1 and the second data line S2.

When a data voltage with any polarity is output to each data line, a pair of a positive-polarity amplifier circuit and a negative-polarity amplifier circuit needs to be provided for each data line. In this regard, in this embodiment, one pair of the positive-polarity amplifier circuit and the negative-polarity amplifier circuit is provided for two data lines by employing a technique of outputting data voltages with opposite polarities to two data lines. This configuration can reduce the scale of the circuit.

Note that although the circuit device 100 includes the polarity setting unit 70 in the above description, the circuit device 100 does not necessarily have to include the polarity setting unit 70. In this case, for example, the following configuration may be employed.

That is to say, the circuit device 100 includes the driving unit 60. In the display panel, each data line is shared by one pixel in the first pixel group and one pixel in the second pixel group. In the first scanning period, the driving unit 60 outputs a data voltage with the first polarity to the first data line, and outputs a data voltage with the second polarity, which is a polarity opposite to the first polarity, to the second data line. In the second scanning period, the driving unit 60 outputs a data voltage with the third polarity to the first data line, and outputs a data voltage with the fourth polarity, which is a polarity opposite to the third polarity, to the second data line. The driving unit 60 includes the driving circuit DR1. The driving circuit DR1 includes the positive-polarity amplifier circuit AMP, the negative-polarity amplifier circuit AMM, the first switching circuit SWA1 that outputs, to the first data line S1, an output voltage from one of the positive-polarity amplifier circuit AMP and the negative-polarity amplifier circuit AMM, and the second switching circuit SWA2 that outputs, to the second data line S2, an output voltage from the other one of the amplifier circuits, the other one being different from the one of the amplifier circuits.

With this configuration as well, effects similar to those described above (e.g. improvement in display quality, a reduction in the scale of the circuit, and a reduction in holding voltage errors) can be achieved.

In this embodiment, in the first scanning period, the first switching circuit SWA1 outputs a data voltage with the first polarity from one of the amplifier circuits to the first data line S1, and the second switching circuit SWA2 outputs a data voltage with the second polarity from the other one of the amplifier circuits to the second data line S2. In the second scanning period, the first switching circuit SWA1 outputs a data voltage with the third polarity from the one of the amplifier circuits to the first data line S1, and the second switching circuit SWA2 outputs a data voltage with the fourth polarity from the other one of the amplifier circuits to the second data line S2.

With this configuration, in the first scanning period, one of a positive voltage and a negative voltage is output as a data voltage with the first polarity to the first data line S1, and the other one is output as a data voltage with the second polarity to the second data line S2. In the second scanning period, one of a positive voltage and a negative voltage is output as a data voltage with the third polarity to the first data line S1, and the other one is output as a data voltage with the fourth polarity to the second data line S2. As a result of this operation of the switching circuits SWA1 and SWA2, data voltages with various polarities can be output as the data voltages with the first polarity, the second polarity, the third polarity, and the fourth polarity. It is also possible to output data voltages with opposite polarities as the data voltages with the first polarity and the second polarity, and output data voltages with opposite polarities as the data voltages with the third polarity and the fourth polarity.

In this embodiment, as shown in FIG. 7, the driving circuit DR1 includes a positive-polarity D/A conversion circuit DAP that is provided on an upstream side of the positive-polarity amplifier circuit AMP, and a negative-polarity D/A conversion circuit DAM that is provided on an upstream side of the negative-polarity amplifier circuit AMM.

Here, "upstream side" does not necessarily mean "immediately before", and indicates that any other circuit may be provided therebetween. For example, in FIG. 7, an output voltage of the positive-polarity D/A conversion circuit DAP is directly input to the positive-polarity amplifier circuit AMP. However, any other circuit may be provided between the output of the positive-polarity D/A conversion circuit DAP and the input of the positive-polarity amplifier circuit AMP.

As a result of this provision of the positive-polarity D/A conversion circuit DAP and the negative-polarity D/A conversion circuit DAM, it is possible to input the output voltage of the positive-polarity D/A conversion circuit DAP (or a voltage based thereon) to the positive-polarity amplifier circuit AMP, and input the output voltage of the negative-polarity D/A conversion circuit DAM (or a voltage based thereon) to the negative-polarity amplifier circuit AMM. In this embodiment, one pair of the positive-polarity D/A conversion circuit DAP and the negative-polarity D/A conversion circuit DAM need only be provided for two data lines. Accordingly, it is possible to reduce the number of D/A conversion circuits and reduce the scale of the circuit.

In this embodiment, the driving unit 60 includes a positive-polarity gray level voltage generation circuit GCP that supplies a plurality of positive-polarity gray level voltages VRP1 to VRP256 to the positive-polarity D/A conversion circuit DAP, and a negative-polarity gray level voltage generation circuit GCM that supplies a plurality of negative-polarity gray level voltages VRM1 to VRM256 to the negative-polarity D/A conversion circuit DAM.

With this configuration, the positive-polarity D/A conversion circuit DAP can select a positive-polarity gray level voltage corresponding to display data from among the plurality of positive-polarity gray level voltages VRP1 to VRP256 supplied from the positive-polarity gray level voltage generation circuit GCP, and output the selected positive-polarity gray level voltage to the positive-polarity amplifier circuit AMP. Also, the negative-polarity D/A conversion circuit DAM can select a negative-polarity gray level voltage corresponding to display data from among the plurality of negative-polarity gray level voltages VRM1 to VRM256 supplied from the negative-polarity gray level voltage generation circuit GCM, and output the selected negative-polarity gray level voltage to the negative-polarity amplifier circuit AMM.

In this embodiment, the first data line S1 is shared by the first pixel (PX11 in the example in FIGS. 2 and 14), which is a pixel in the first pixel group, and the second pixel (PX12), which is a pixel in the second pixel group. The second data line S2 is shared by the third pixel (PX13), which is a pixel in the first pixel group, and the fourth pixel (PX14), which is a pixel in the second pixel group.

In the first scanning period, the driving unit 60 outputs a data voltage with the first polarity for the first pixel to the first data line S1 shared by the first pixel and the second pixel, and outputs a data voltage with the second polarity for the third pixel to the second data line S2 shared by the third pixel and the fourth pixel. In the second scanning period, the driving unit 60 outputs a data voltage with the third polarity for the second pixel to the first data line S1, and outputs a data voltage with the fourth polarity for the fourth pixel to the second data line S2.

With this configuration, data voltages with the first polarity, the third polarity, the second polarity, and the fourth polarity are written respectively in the first pixel, the second pixel, the third pixel, and the fourth pixel on the display line that is provided in correspondence with the scan lines G1 and G2. Thus, the data voltages are written in the respective pixels in accordance with the first polarity, the second polarity, the third polarity, and the fourth polarity that are set by the polarity setting unit 70. These polarities can be set in various manners, and two-dot inversion driving can thereby be performed with various polarity patterns.

In this embodiment, the display panel has a third pixel group (PX21 and PX23) selected by a third scan line G3, of the third scan line G3 and a fourth scan line G4 that are provided in correspondence with a second display line, and a fourth pixel group (PX22 and PX24) selected by the fourth scan line G4. Each data line (e.g. the data line S1) is shared by one pixel (PX21) in the third pixel group and one pixel (PX22) in the fourth pixel group.

Figure 12:
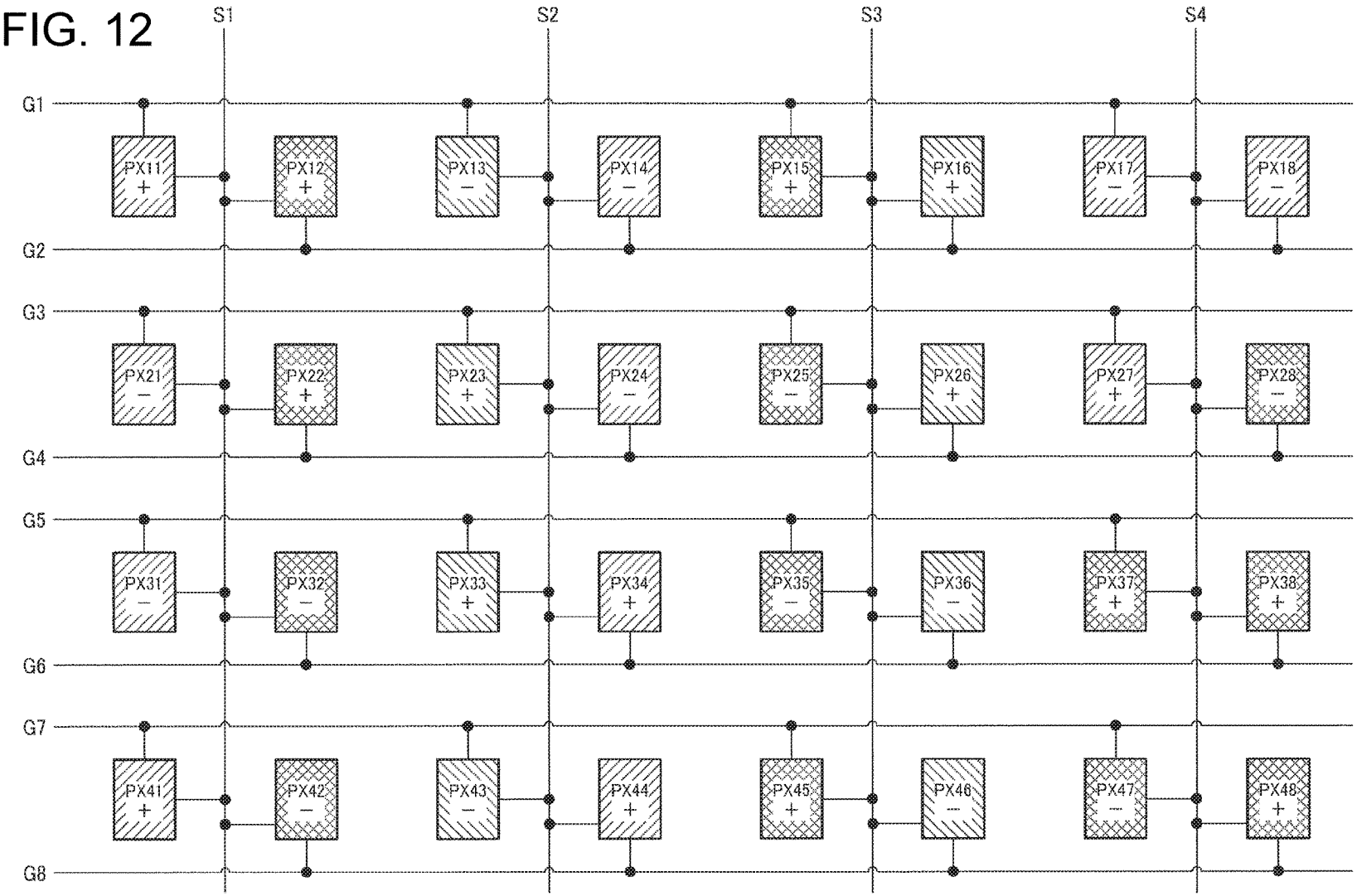
FIG. 12 shows a third polarity pattern.

As shown in FIG. 12, in the first scanning period in which the first pixel group is selected by the first scan line G1, the driving unit 60 outputs a positive data voltage to the first data line S1, and outputs a negative data voltage to the second data line S2. In the second scanning period in which the second pixel group is selected by the second scan line G2, the driving unit 60 outputs a positive data voltage to the first data line S1, and outputs a negative data voltage to the second data line S2. In a third scanning period in which the third pixel group is selected by the third scan line G3, the driving unit 60 outputs a negative data voltage to the first data line S1, and outputs a positive data voltage to the second data line S2. In the fourth scanning period in which the fourth pixel group is selected by the fourth scan line G4, the driving unit 60 outputs a positive data voltage to the first data line S1, and outputs a negative data voltage to the second data line S2.

According to this embodiment, in the first scanning period, a positive data voltage and a negative data voltage are output respectively to the first data line S1 and the second data line S2. In the second scanning period, a positive data voltage and a negative data voltage are output respectively thereto. In the third scanning period, a negative data voltage and a positive data voltage are output respectively thereto, and in the fourth scanning period, a positive data voltage and a negative data voltage are output respectively thereto.

With this configuration, in the first pixel group and the second pixel group that are selected respectively by the first scan line and the second scan line, the boundaries between pixels in which data voltages with opposite polarities are written can be set between pixels that do not share a data line (e.g. between the pixels PX12 and PX13 in FIG. 12). On the other hand, in the third pixel group and the fourth pixel group that are selected respectively by the third scan line and the fourth scan line, the boundaries can be set between pixels that share a data line (e.g. between the pixels PX21 and PX22 in FIG. 12). Accordingly, the boundaries between pixels in which data voltages with opposite polarities are written are located at different positions in the first pixel group and the second pixel group selected respectively by the first scan line and the second scan line (i.e. the pixel groups corresponding to the first display line), and in the third pixel group and the fourth pixel group selected respectively by the third scan line and the fourth scan line (i.e. the pixel groups corresponding to the second display line). The positions of the boundaries can thus be shifted in the column direction. It is thereby possible to suppress the occurrence of vertical lines in every two columns that is unique to display panels having a dual-gate structure, and to achieve improvement in display quality and the like.

Note that, in the above-described configuration, the circuit device 100 includes the polarity setting unit 70, and the driving unit 60 outputs data voltages with opposite polarities to the first data line and the second data line. However, the circuit device 100 does not necessarily have to include the polarity setting unit 70, and the driving unit 60 does not necessarily have to be configured to output data voltages with opposite polarities to the first data line and the second data line (e.g. the driving unit 60 is configured to be able to output a data voltage with any polarity to each data line, and under this configuration, the driving unit 60 may output the above-described polarity pattern). In this case, the circuit device 100 may have the following configuration.

That is to say, the circuit device 100 includes the driving unit 60 and the control unit 20. In the display panel, each data line is shared by one pixel in the first pixel group and one pixel in the second pixel group, and each data line is shared by one pixel in the third pixel group and one pixel in the fourth pixel group. In the first scanning period, the driving unit 60 outputs a positive data voltage to the first data line, and outputs a negative data voltage to the second data line. In the second scanning period, the driving unit 60 outputs a positive data voltage to the first data line, and outputs a negative data voltage to the second data line. In the third scanning period, the driving unit 60 outputs a negative data voltage to the first data line, and outputs a positive data voltage to the second data line. In the fourth scanning period, the driving unit 60 outputs a positive data voltage to the first data line, and outputs a negative data voltage to the second data line.

With this configuration as well, effects similar to those described above (e.g. improvement in display quality) can be achieved.

More specifically, the first data line S1 is shared by the fifth pixel (PX21), which is a pixel in the third pixel group, and the sixth pixel (PX22), which is a pixel in the fourth pixel group. The second data line S2 is shared by the seventh pixel (PX23), which is a pixel in the third pixel group, and the eighth pixel (PX24), which is a pixel in the fourth pixel group.

In the first scanning period, the driving unit 60 outputs a positive data voltage for the first pixel to the first data line S1, and outputs a negative data voltage for the third pixel to the second data line S2. In the second scanning period, the driving unit 60 outputs a positive data voltage for the second pixel to the first data line S1, and outputs a negative data voltage for the fourth pixel to the second data line S2. In the third scanning period, the driving unit 60 outputs a negative data voltage for the fifth pixel to the first data line S1, and outputs a positive data voltage for the seventh pixel to the second data line S2. In the fourth scanning period, the driving unit 60 outputs a positive data voltage for the sixth pixel to the first data line S1, and outputs a negative data voltage for the eighth pixel to the second data line S2.

According to this embodiment, a positive data voltage, a positive data voltage, a negative data voltage, and a negative data voltage are written respectively in the first pixel PX11, the second pixel PX12, the third pixel PX13, and the fourth pixel PX14 on the first display line. A negative data voltage, a positive data voltage, a positive data voltage, and a negative data voltage are written respectively in the fifth pixel PX21, the sixth pixel PX22, the seventh pixel PX23, and the eighth pixel PX24 on the second display line. That is to say, the boundaries between pixels in which data voltages with opposite polarities are written are located between the second pixel PX12 and the third pixel PX13 on the first display line, and between the fifth pixel PX21 and the sixth pixel PX22 and between the seventh pixel PX23 and the eighth pixel PX24 on the second display line. The boundaries are thus shifted in the column direction.

In this embodiment, the display panel also has a fifth pixel group (PX31 and PX33) selected by a fifth scan line G5, of the fifth scan line G5 and a sixth scan line G6 that are provided in correspondence with a third display line, a sixth pixel group (PX32 and PX34) selected by the sixth scan line G6, a seventh pixel group (PX41 and PX43) selected by a seventh scan line G7, of the seventh scan line G7 and an eighth scan line G8 that are provided in correspondence with a fourth display line, and an eighth pixel group (PX42 and PX44) selected by the eighth scan line G8. Each data line (e.g. the data line S1) is shared by one pixel (PX31) in the fifth pixel group and one pixel (PX32) in the sixth pixel group, and each data line (e.g. the data line S1) is shared by one pixel (PX41) in the seventh pixel group and one pixel (PX42) in the eighth pixel group.

As shown in FIG. 12, in a fifth scanning period in which the fifth pixel group is selected by the fifth scan line G5, the driving unit 60 outputs a negative data voltage to the first data line S1, and outputs a positive data voltage to the second data line S2. In a sixth scanning period in which the sixth pixel group is selected by the sixth scan line G6, the driving unit 60 outputs a negative data voltage to the first data line S1, and outputs a positive data voltage to the second data line S2. In a seventh scanning period in which the seventh pixel group is selected by the seventh scan line G7, the driving unit 60 outputs a positive data voltage to the first data line S1, and outputs a negative data voltage to the second data line S2. In an eighth scanning period in which the eighth pixel group is selected by the eighth scan line G8, the driving unit 60 outputs a negative data voltage to the first data line S1, and outputs a positive data voltage to the second data line S2.

More specifically, the first data line S1 is shared by a ninth pixel PX31, which is a pixel in the fifth pixel group, and a tenth pixel PX32, which is a pixel in the sixth pixel group. The second data line S2 is shared by an eleventh pixel PX33, which is a pixel in the fifth pixel group, and a twelfth pixel PX34, which is a pixel in the sixth pixel group. The first data line S1 is shared by a thirteenth pixel PX41, which is a pixel in the seventh pixel group, and a fourteenth pixel PX42, which is a pixel in the eighth pixel group. The second data line S2 is shared by a fifteenth pixel PX43, which is a pixel in the seventh pixel group, and a sixteenth pixel PX44, which is a pixel in the eighth pixel group.

In the fifth scanning period, the driving unit 60 outputs a negative data voltage for the ninth pixel to the first data line S1 shared by the ninth pixel PX31 and the tenth pixel PX32, and outputs a positive data voltage for the eleventh pixel to the second data line S2 shared by the eleventh pixel PX33 and the twelfth pixel PX34. In the sixth scanning period, the driving unit 60 outputs a negative data voltage for the tenth pixel to the first data line S1, and outputs a positive data voltage for the twelfth pixel to the second data line S2. In the seventh scanning period, the driving unit 60 outputs a positive data voltage for the thirteenth pixel to the first data line S1 shared by the thirteenth pixel PX41 and the fourteenth pixel PX42, and outputs a negative data voltage for the fifteenth pixel to the second data line S2 shared by the fifteenth pixel PX43 and the sixteenth pixel PX44. In the eighth scanning period, the driving unit 60 outputs a negative data voltage for the fourteenth pixel to the first data line S1, and outputs a positive data voltage for the sixteenth pixel to the second data line S2.

According to this embodiment, a negative data voltage, a negative data voltage, a positive data voltage, and a positive data voltage are written respectively in the ninth pixel PX31, the tenth pixel PX32, the eleventh pixel PX33, and the twelfth pixel PX34 on the third display line. A positive data voltage, a negative data voltage, a negative data voltage, and a positive data voltage are written respectively in the thirteenth pixel PX41, the fourteenth pixel PX42, the fifteenth pixel PX43, and the sixteenth pixel PX44 on the fourth display line. That is to say, the boundaries between pixels in which data voltages with opposite polarities are written are located between the tenth pixel PX32 and the eleventh pixel PX33 on the third display line, and between the thirteenth pixel PX41 and the fourteenth pixel PX42 and between the fifteenth pixel PX43 and the sixteenth pixel PX44 on the fourth display line. The boundaries are thus shifted in the column direction. It is thereby possible to suppress the occurrence of vertical lines in every two columns that is unique to display panels having a dual-gate structure, and to achieve improvement in display quality and the like.

2. Data Line Driving Unit

FIG. 6 shows an exemplary detailed configuration of the data line driving unit 40. The data line driving unit 40 includes a gray level voltage generation circuit 42 and a plurality of driving circuits DR1 to DRk (k is an integer of 2 or greater).

The gray level voltage generation circuit 42 generates a plurality of positive-polarity gray level voltages that are used in the case of driving a pixel with a positive data voltage, and a plurality of negative-polarity gray level voltages that are used in the case of driving a pixel with a negative data voltage, and outputs the generated gray level voltages to the plurality of driving circuits DR1 to DRk.

Each of the plurality of driving circuits DR1 to DRk drives two data lines based on the plurality of positive-polarity gray level voltages, the plurality of negative-polarity gray level voltages, and display data from the control unit 20. That is to say, k=n/2 driving circuits are provided for first to nth data line driving terminals TS1 to TSn. Each driving circuit drives two data lines with opposite polarities. Taking the driving circuit DR1 as an example, when a positive data voltage SV1 is output to one of the data lines, namely the data line S1, the driving circuit DR1 outputs a negative data voltage SV2 to the other data line, namely the data line S2. When a negative data voltage SV1 is output to one of the data lines, namely the data line S1, the driving circuit DR1 outputs a positive data voltage SV2 to the other data line, namely the data line S2. Thus, there are two manners of choosing the polarity, whereas each driving circuit may select either of the polarities arbitrarily (independently).

The control unit 20 outputs, to each driving circuit, display data corresponding to two data lines that are driven by this driving circuit. For example, on the display line connected to the scan lines G1 and G2, the pixels PX11 to PX14 are connected to the two data lines S1 and S2. That is to say, when one display line is driven (i.e. in one horizontal scanning period), the control unit 20 outputs display data for four pixels to one driving circuit. Writing for one display line is performed by two scan lines G1 and G2 in a time-division manner. Therefore, in a period in which one scan line selects pixels, the control unit 20 outputs display data for two pixels to one driving circuit.

FIG. 7 shows an exemplary detailed configuration of the driving circuits. Although FIG. 7 shows the driving circuit DR1 as an example, the driving circuits DR2 to DRk can also be configured in a similar manner. The driving circuit DR1 includes the first switching circuit SWA1, the second switching circuit SWA2, the positive-polarity amplifier circuit AMP, the negative-polarity amplifier circuit AMM, the positive-polarity D/A conversion circuit DAP, the negative-polarity D/A conversion circuit DAM, a third switching circuit SWB1, a fourth switching circuit SWB2, and the gray level voltage generation circuit 42.

The first switching circuit SWA1 includes a switching element SPA1 that connects the output of the positive-polarity amplifier circuit AMP to the data line driving terminal TS1, and a switching element SMA1 that connects the output of the negative-polarity amplifier circuit AMM to the data line driving terminal TS1.

The second switching circuit SWA2 includes a switching element SMA2 that connects the output of the negative-polarity amplifier circuit AMM to the data line driving terminal TS2, and a switching element SPA2 that connects the output of the positive-polarity amplifier circuit AMP to the data line driving terminal TS2.

The third switching circuit SWB1 includes a switching element SPB1 that inputs display data HD1 for the first data line S1 to the positive-polarity D/A conversion circuit DAP, and a switching element SMB1 that inputs display data HD2 for the second data line S2 to the positive-polarity D/A conversion circuit DAP.

The fourth switching circuit SWB2 includes a switching element SMB2 that inputs the display data HD2 for the second data line S2 to the negative-polarity D/A conversion circuit DAM, and a switching element SPB2 that inputs the display data HD1 for the first data line S1 to the negative-polarity D/A conversion circuit DAM.

The first and second switching circuits SWA1 and SWA2 are constituted by transistor circuits, such as transfer gates, for example. The third and fourth switching circuits SWB1 and SWB2 are constituted by selectors that use a logic circuit, for example. These switching circuits SWA1, SWA2, SWB1, and SWB2 are subjected to on-off control by a control signal from the control unit 20.

The gray level voltage generation circuit 42 includes the positive-polarity gray level voltage generation circuit GCP that outputs a plurality of positive-polarity gray level voltages VRP1 to VRP256, and the negative-polarity gray level voltage generation circuit GCM that outputs a plurality of negative-polarity gray level voltages VRM1 to VRM256. Note that, although a case of 256 gray levels is taken as an example in this description, the number of gray levels is not limited to 256.

Operation of the driving circuit DR1 will be described below. In a first state where the data lines S1 and S2 are driven respectively with a positive polarity and a negative polarity, the switching elements SPA1, SMA2, SPB1, and SMB2 are turned on. In this case, the positive-polarity D/A conversion circuit DAP selects a voltage DPQ that corresponds to the display data HD1 for the first data line S1 from among the plurality of positive-polarity gray level voltages VRP1 to VRP256. The positive-polarity amplifier circuit AMP drives the first data line S1 with the positive data voltage SV1 based on the selected voltage DPQ. Meanwhile, the negative-polarity D/A conversion circuit DAM selects a voltage DMQ that corresponds to the display data HD2 for the second data line S2 from among the plurality of negative-polarity gray level voltages VRM1 to VRM 256. The negative-polarity amplifier circuit AMM drives the second data line S2 with the negative data voltage SV2 based on the selected voltage DMQ.

On the other hand, in a second state where the data lines S1 and S2 are driven respectively with a negative polarity and a positive polarity, the switching elements SMA1, SPA2, SMB1, and SPB2 are turned on. In this case, the negative-polarity D/A conversion circuit DAM selects the voltage DMQ that corresponds to the display data HD1 for the first data line S1 from among the plurality of negative-polarity gray level voltages VRM1 to VRM 256. The negative-polarity amplifier circuit AMM drives the first data line S1 with the negative data voltage SV1 based on the selected voltage DMQ. Meanwhile, the positive-polarity D/A conversion circuit DAP selects the voltage DPQ that corresponds to the display data HD2 for the second data line S2 from among the plurality of positive-polarity gray level voltages VRP1 to VRP256. The positive-polarity amplifier circuit AMP drives the second data line S2 with the positive data voltage SV2 based on the selected voltage DPQ.

Writing for one display line is performed by two scan lines G1 and G2 in a time-division manner. Therefore, in a period in which each scan line selects pixels, the driving circuit DR1 performs the writing in pixels in either the first state or the second state. Any combination of the periods in which the scan lines G1 and G2 select pixels and the first and second states may be employed (independently), and the driving can be performed with various polarity patterns.

With the above configuration and operation of the driving circuit DR1, operation is achieved in which a data voltage with the first polarity is output to the first data line (S1), and a data voltage with the second polarity, which is a polarity opposite to the first polarity, is output to the second data line (S2).

3. Positive-Polarity Amplifier Circuit and Negative-Polarity Amplifier Circuit

Figure 8A:
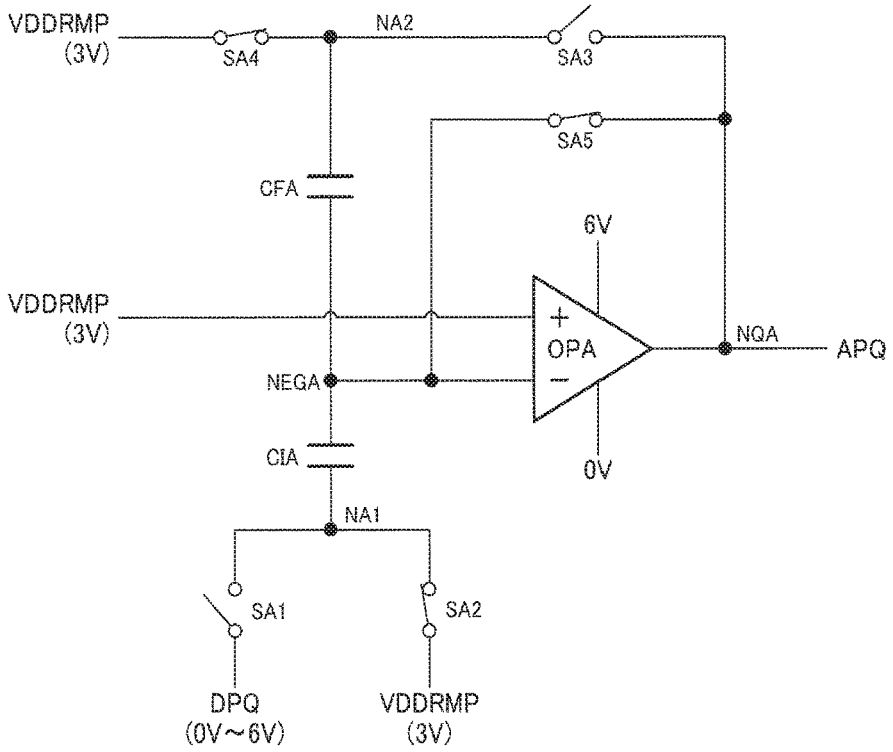
FIGS. 8A and 8B show an exemplary detailed configuration of a positive-polarity amplifier circuit.
Figure 8B:
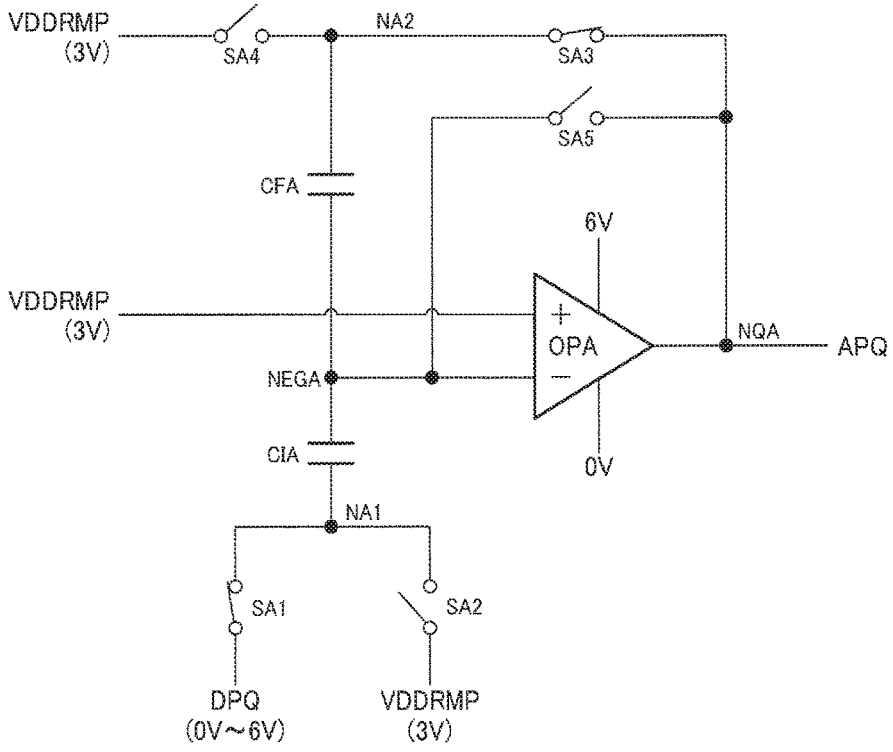

FIGS. 8A and 8B show an exemplary detailed configuration of the positive-polarity amplifier circuit AMP. FIG. 8A shows a state of switching elements in an initialization period (a period for setting a voltage for initialization at capacitors CIA and CFA), and FIG. 8B shows a state of the switching elements in an output period (a period for outputting an output voltage and driving a driving target).

As shown in FIG. 8A, the positive-polarity amplifier circuit AMP has an op-amp OPA (an operational amplifier), capacitors CIA and CFA, and switching elements SA1 to SA5. This positive-polarity amplifier circuit AMP is a circuit that receives an input voltage DPQ, outputs an output voltage APQ, and drives a data line. The input voltage DPQ is 0 V to +6 V, for example.

The capacitor CIA is provided between a node NA1 and a summing node NEGA (an inverting input terminal node; a charge storage node) connected to a first input terminal (an inverting input terminal) of the op-amp OPA. The capacitor CFA is provided between the summing node NEGA and a node NA2. A node of an analog reference voltage VDDRMP is connected to a second input terminal (a non-inverting input terminal) of the op-amp OPA.

The switching element SA1 is provided between an input node NIA of the positive-polarity amplifier circuit AMP and the node NA1. The switching element SA2 is provided between a node of an analog reference voltage VDDRMP and the node NA1. The switching element SA3 is provided between the node NA2 and an output node NQA. The switching element SA4 is provided between the node NA2 and a node of an analog reference voltage VDDRMP. The switching element SA5 is provided between the summing node NEGA and the output node NQA.

These switching elements SA1 to SA5 are constituted by transistor circuits such as transfer gates, for example, and are subjected to on-off control by a switching control signal from the control unit 20. The analog reference voltages VDDRMP are a voltage (e.g. +3 V) between a positive-polarity high-potential voltage (e.g. +6 V) and a positive polarity low-potential power supply (e.g. 0 V), and are supplied from a power supply circuit (not shown) that is included in the circuit device 100 or provided outside the circuit device 100.

As shown in FIG. 8A, in the initialization period, the switching elements SA2, SA4, and SA5 are turned on, and the switching elements SA1 and SA3 are turned off. By the switching element SA2 being turned on, one end of the capacitor CIA, the other end of which is electrically connected to the summing node NEGA, is set to the analog reference voltage VDDRMP. Similarly, by the switching element SA4 being turned on, one end of the capacitor CFA, the other end of which is electrically connected to the summing node NEGA, is set to the analog reference voltage VDDRMP. Also, by the switching element SA5, which is a feedback switching element, being turned on, the output of the op-amp OPA is fed back to the inverting input terminal thereof, and the summing node NEGA is set to the voltage of the analog reference voltage VDDRMP due to an imaginary short circuit function of the op-amp OPA. The voltage at the analog reference voltage VDDRMP serves as the output voltage APQ of the positive-polarity amplifier circuit AMP.

As shown in FIG. 8B, in the output period, the switching elements SA1 and SA3 are turned on, and the switching elements SA2, SA4, and SA5 are turned off. By the switching element SA1 being turned on, the one end of the capacitor CIA, the other end of which is connected to the summing node NEGA, is set to the input voltage DPQ. By the switching element SA3 being turned on, the one end of the capacitor CFA, the other end of which is connected to the summing node NEGA, is set to the output voltage APQ. Thus, the output voltage APQ is expressed by Formula (1) below. Note that $C_{CIA}$ denotes the capacitance of the capacitor CIA, and $C_{CFA}$ denotes the capacitance of the capacitor CFA.

$$APQ=VDDRMP-(C_{CIA}/C_{CFA})\times(DPQ-VDDRMP) \quad (1)$$

Figure 9A:
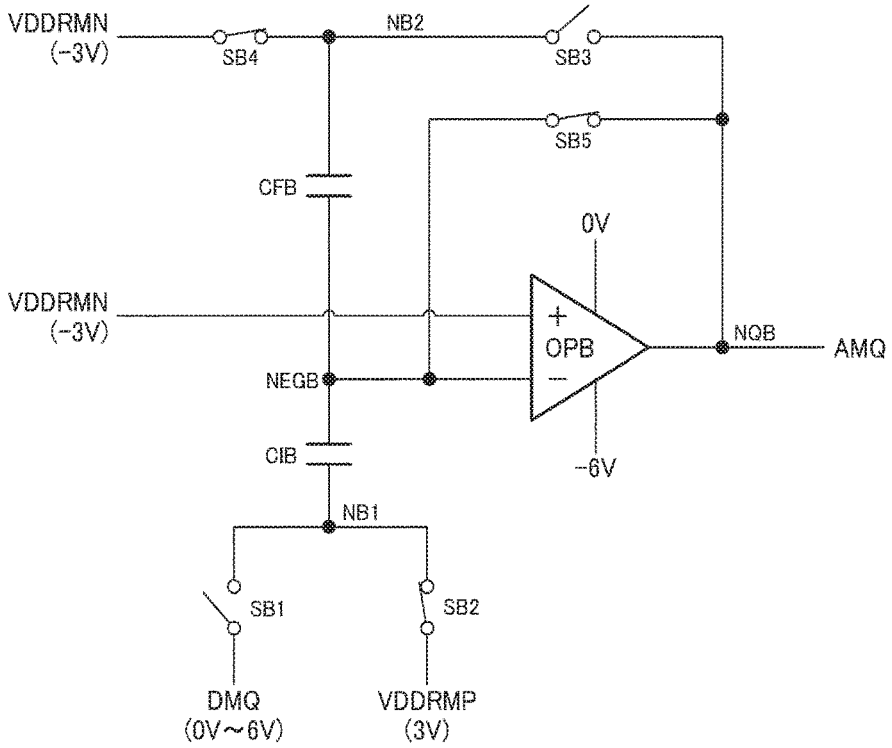
FIGS. 9A and 9B show an exemplary detailed configuration of a negative-polarity amplifier circuit.
Figure 9B:
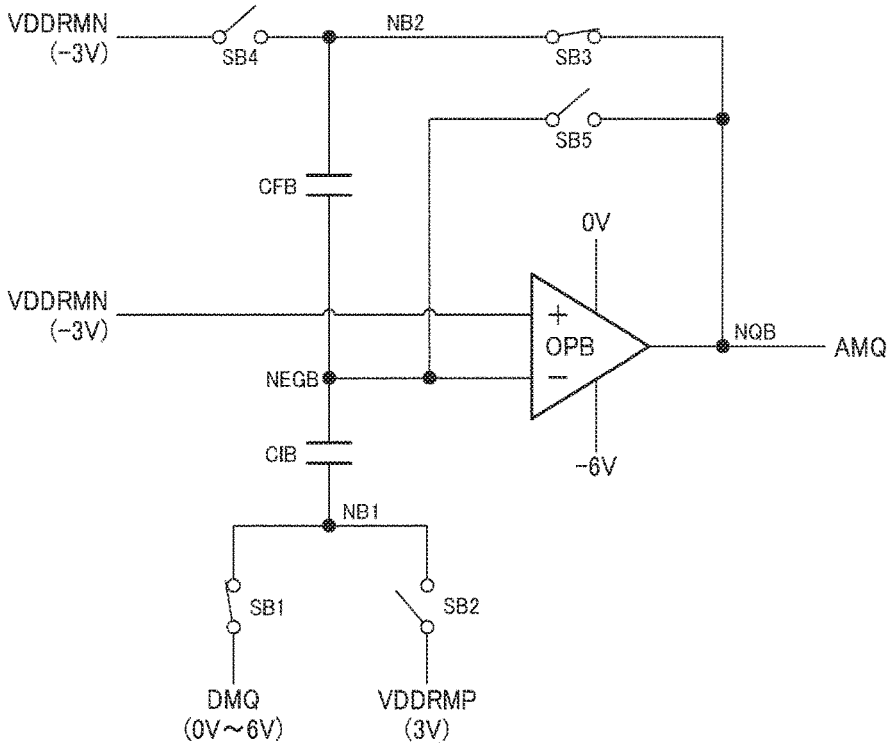

FIGS. 9A and 9B show an exemplary detailed configuration of the negative-polarity amplifier circuit AMM. FIG. 9A shows a state of switching elements in the initialization period, and FIG. 9B shows a state of the switching element in the output period.

As shown in FIG. 9A, the negative-polarity amplifier circuit AMM has an op-amp OPB (an operational amplifier), capacitors CIB and CFB, and switching elements SB1 to SB5. This negative-polarity amplifier circuit AMM is a circuit that receives the input voltage DMQ, outputs an output voltage AMQ, and drives a data line. The input voltage DMQ is 0 V to +6 V, for example.

The configuration and operation of the negative-polarity amplifier circuit AMM are similar to those of the positive-polarity amplifier circuit AMP. That is to say, the op-amp OPB corresponds to the op-amp OPA, the capacitors CIB and CFB correspond respectively to the capacitors CIA and CFA, and the switching elements SB1 to SB5 correspond respectively to the switching elements SA1 to SA5. However, analog reference voltages connected to one end of the switching element SB4 and to a second input terminal (a non-inverting input terminal) of the op-amp OPB are VDDRMN. The analog reference voltages VDDRMN are a voltage (e.g. −3 V) between a negative-polarity high-potential power supply (e.g. 0 V) and a negative-polarity low-potential power supply (e.g. −6 V), and is supplied from a power supply circuit (not shown) that is included in the circuit device 100 or provided outside the circuit device 100.

In the initialization period shown in FIG. 9A, the voltage at the analog reference voltage VDDRMN serves as the output voltage AMQ. In the output period shown in FIG. 9B, the output voltage AMQ is expressed by Formula (2) below.

$$AMQ=VDDRMN-(C_{CIA}/C_{CFA})\times(DAC-VDDRMP) \quad (2)$$

For example, in each horizontal scanning period, initially, the initialization period is set to initialize the positive-polarity amplifier circuit AMP and the negative-polarity amplifier circuit AMM, and next, the output period is set to output data voltages from the positive-polarity amplifier circuit AMP and the negative-polarity amplifier circuit AMM. In the output period, initially, an odd-numbered scan line (e.g. the scan line G1) is selected, and the positive-polarity amplifier circuit AMP and the negative-polarity amplifier circuit AMM perform the writing in the pixels connected to this odd-numbered scan line. Next, an even-numbered scan line (e.g. the scan line G2) is selected, and the positive-polarity amplifier circuit AMP and the negative-polarity amplifier circuit AMM perform the writing in the pixels connected to this even-numbered scan line.

Note that if the amplifier circuits in FIGS. 8A to 9B are employed in the driving circuit in FIG. 7, for example, the positive-polarity D/A conversion circuit DAP and the negative-polarity D/A conversion circuit DAM may be configured as one common D/A conversion circuit having a gray level voltage range of 0 V to +6 V. In this case, the positive-polarity gray level voltage generation circuit GCP and the negative-polarity gray level voltage generation circuit GCM are also configured as a common circuit. Alternatively, in the case of separating the positive-polarity D/A conversion circuit DAP from the negative-polarity D/A conversion circuit DAM as in FIG. 7, the negative-polarity D/A conversion circuit DAM may output the output voltage DMQ in the range from 0V to −6V, and this output voltage DMQ may be input to an input node NIB of the negative-polarity amplifier circuit AMM. In this case, the analog reference voltage VDDRMN (e.g. −3 V) is input to one end of the switching element SB2.

4. Polarity Pattern

A description will be given, using FIGS. 10 to 13, of a polarity pattern (a polarity inversion pattern) at the time when the circuit device 100 according to this embodiment drives the display panel having a dual-gate structure. The polarity pattern is a pattern in which each pixel (strictly speaking, the scan line and the data line to which each pixel is connected) in the display panel is associated with the polarity of the data voltage to be written in this pixel. In FIGS. 10 to 13, signs "+" and "−" that follow pixel signs indicate a positive polarity and a negative polarity, respectively. FIGS. 10 to 13 show a driving polarity for each pixel in a certain frame, and each pixel is driven with the opposite polarity in the next frame.

Figure 14:
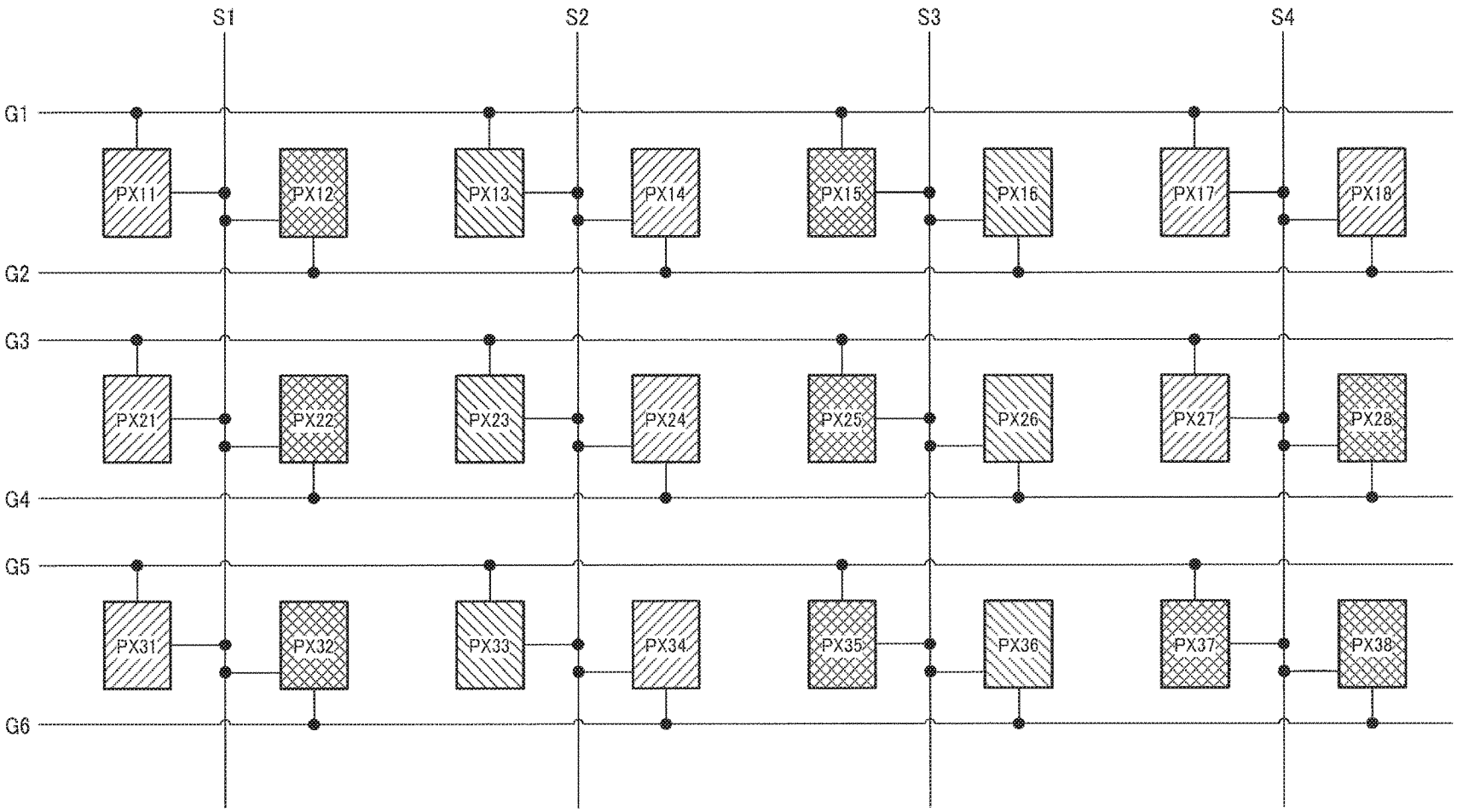
FIG. 14 shows a first exemplary configuration of a display panel.

Although the following description takes a display panel having a configuration shown in FIG. 14 (FIG. 2) as an example, the invention is not limited thereto. For example, the polarity pattern according to this embodiment is also applicable to display panels having configurations shown in FIGS. 15 and 16.

FIG. 10 shows a first polarity pattern. The following description will be given, taking the polarity pattern for the pixels PX11 to PX14 and PX21 to PX24 as an example. In other pixels, a similar polarity pattern is repeated.

Positive and negative data voltages are written respectively in the pixels PX11 and PX13 (a first pixel and a third pixel) that are connected to the scan line G1, via the data lines S1 and S2. Negative and positive data voltages are written respectively in the pixels PX12 and PX14 (a second pixel and a fourth pixel) that are connected to the scan line G2, via the data lines S1 and S2. Negative and positive data voltages are written respectively in the pixels PX21 and PX23 (a fifth pixel and a seventh pixel) that are connected to the scan line G3, via the data lines S1 and S2. Positive and negative data voltages are written respectively in the pixels PX22 and PX24 (a sixth pixel and an eighth pixel) that are connected to the scan line G4, via the data lines S1 and S2.

The first polarity, the second polarity, the third polarity, and the fourth polarity that are set by the polarity setting unit 70 correspond respectively to a positive polarity, a negative polarity, a negative polarity, and a positive polarity.

In this first polarity pattern, a positive polarity and a negative polarity are alternately located when seeing the polarity pattern for pixels in one column.

Figure 11:
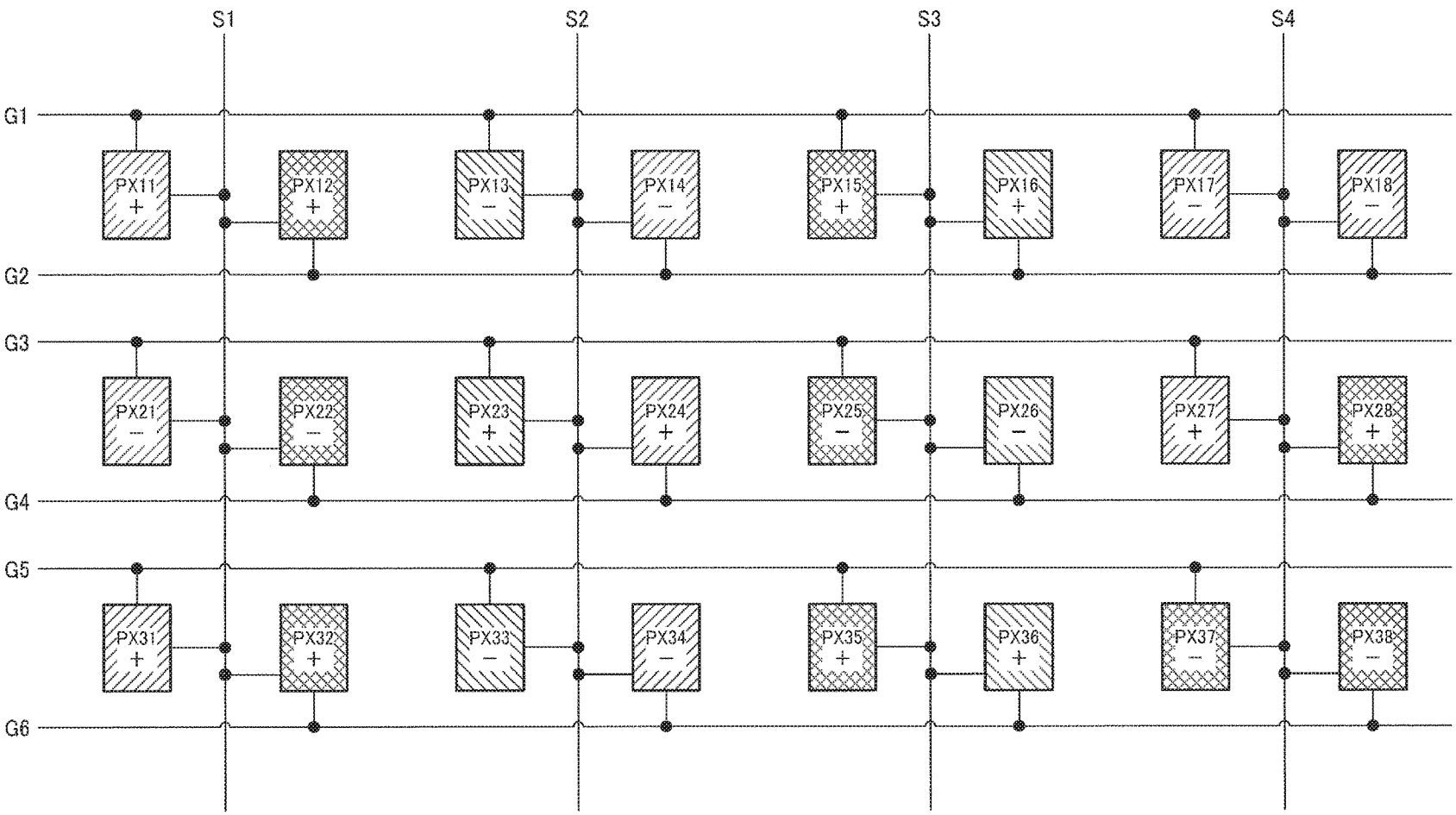
FIG. 11 shows a second polarity pattern.

FIG. 11 shows a second polarity pattern. The following description will be given, taking the polarity pattern for the pixels PX11 to PX14 and PX21 to PX24 as an example. In other pixels, a similar polarity pattern is repeated.

Positive and negative data voltages are written respectively in the pixels PX11 and PX13 that are connected to the scan line G1, via the data lines S1 and S2. Positive and negative data voltages are written respectively in the pixels PX12 and PX14 that are connected to the scan line G2, via the data lines S1 and S2. Negative and positive data voltages are written respectively in the pixels PX21 and PX23 that are connected to the scan line G3, via the data lines S1 and S2. Negative and positive data voltages are written respectively in the pixels PX22 and PX24 that are connected to the scan line G4, via the data lines S1 and S2.

The first polarity, the second polarity, the third polarity, and the fourth polarity that are set by the polarity setting unit 70 correspond respectively to a positive polarity, a negative polarity, a positive polarity, and a negative polarity.

In this second polarity pattern, similar to the first polarity pattern, a positive polarity and a negative polarity are alternately located when seeing the polarity pattern for pixels in one column. A difference from the first polarity pattern lies in that the second polarity pattern is a pattern obtained by shifting the first polarity pattern by one pixel in the horizontal scan direction.

FIG. 12 shows a third polarity pattern. The following description will be given, taking the polarity pattern for the pixels PX11 to PX14, PX21 to PX24, PX31 to PX34, and PX41 to PX44 as an example. In other pixels, a similar polarity pattern is repeated.

Positive and negative data voltages are written respectively in the pixels PX11 and PX13 that are connected to the scan line G1, via the data lines S1 and S2. Positive and negative data voltages are written respectively in the pixels PX12 and PX14 that are connected to the scan line G2, via the data lines S1 and S2. Negative and positive data voltages are written respectively in the pixels PX21 and PX23 that are connected to the scan line G3, via the data lines S1 and S2. Positive and negative data voltages are written respectively in the pixels PX22 and PX24 that are connected to the scan line G4, via the data lines S1 and S2.

Negative and positive data voltages are written respectively in the pixels PX31 and PX33 (a ninth pixel and an eleventh pixel) that are connected to the scan line G5, via the data lines S1 and S2. Negative and positive data voltages are written respectively in the pixels PX32 and PX34 (a tenth pixel and a twelfth pixel) that are connected to the scan line G6, via the data lines S1 and S2. Positive and negative data voltages are written respectively in the pixels PX41 and PX43 (a thirteenth pixel and a fifteenth pixel) that are connected to the scan line G7, via the data lines S1 and S2. Negative and positive data voltages are written respectively in the pixels PX42 and PX44 (a fourteenth pixel and a sixteenth pixel) that are connected to the scan line G8, via the data lines S1 and S2.

The first polarity, the second polarity, the third polarity, and the fourth polarity that are set by the polarity setting unit 70 correspond respectively to a positive polarity, a negative polarity, a positive polarity, and a negative polarity.

In this third polarity pattern, a pattern is shifted obliquely (i.e. obliquely downward to the right of the screen). That is to say, the polarity pattern for pixels in one column is shifted by one pixel in every row in the same direction.

Figure 13:
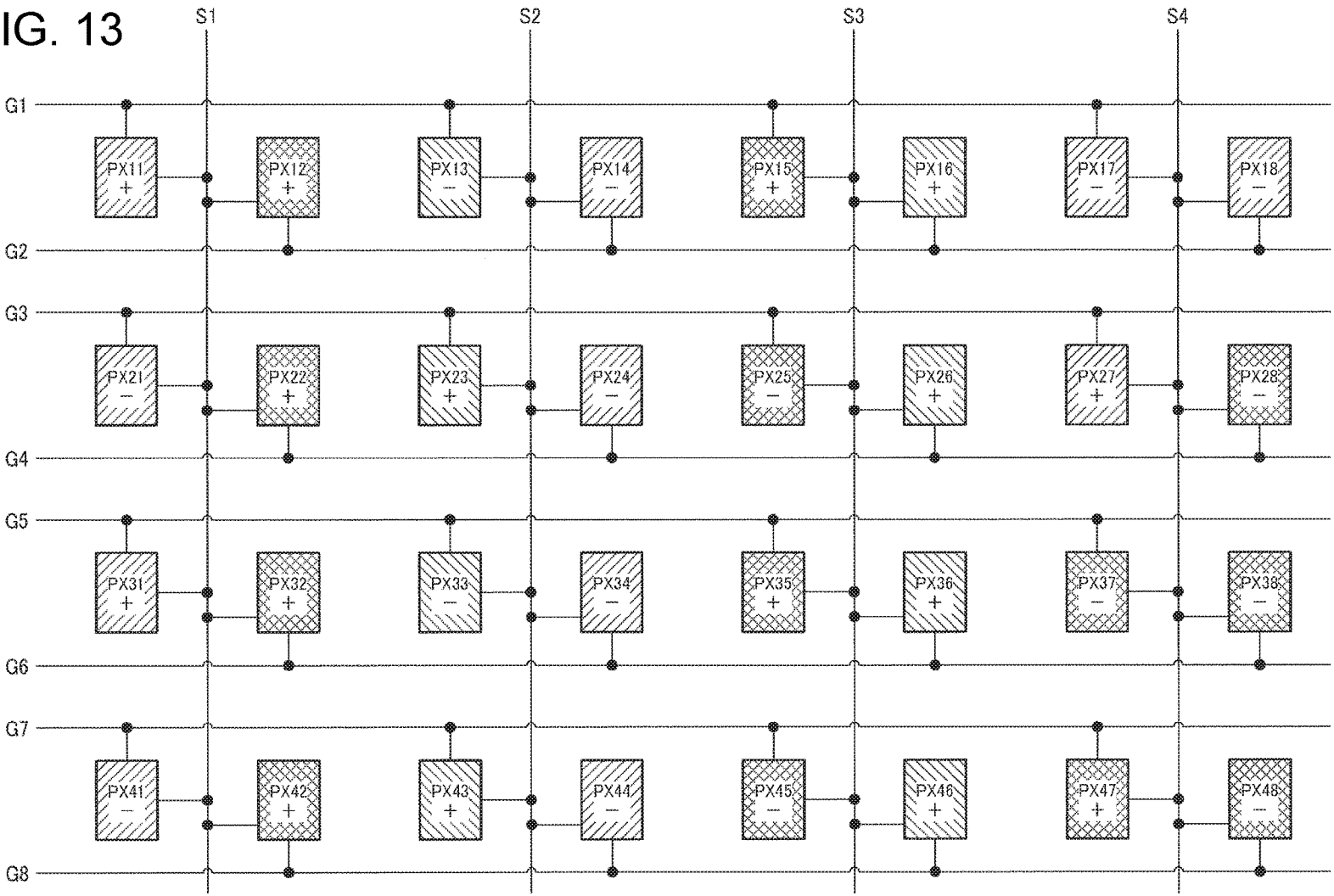
FIG. 13 shows a fourth polarity pattern.

FIG. 13 shows a fourth polarity pattern. The following description will be given, taking the polarity pattern for the pixels PX11 to PX14 and PX21 to PX24 as an example. In other pixels, a similar polarity pattern is repeated.

Positive and negative data voltages are written respectively in the pixels PX11 and PX13 that are connected to the scan line G1, via the data lines S1 and S2. Positive and negative data voltages are written respectively in the pixels PX12 and PX14 that are connected to the scan line G2, via the data lines S1 and S2. Negative and positive data voltages are written respectively in the pixels PX21 and PX23 that are connected to the scan line G3, via the data lines S1 and S2. Positive and negative data voltages are written respectively in the pixels PX22 and PX24 that are connected to the scan line G4, via the data lines S1 and S2. The first polarity, the second polarity, the third polarity, and the fourth polarity that are set by the polarity setting unit 70 correspond respectively to a positive polarity, a negative polarity, a positive polarity, and a negative polarity.

In this fourth polarity pattern, a pattern is shifted obliquely (i.e. obliquely downward to the left and right of the screen), and the shifting direction changes alternately. That is to say, the polarity pattern for pixels in one row is shifted by one pixel to the right of the screen in the next row, and is shifted by one pixel to the left of the screen in the subsequent row (i.e. returns to the original pattern).

In the above first to fourth polarity patterns, data voltages with opposite polarities are written in two pixels (e.g. the pixels PX11 and PX13) that are selected by the same scan line (i.e. driven simultaneously) among pixels driven by one driving circuit. As a result, the polarity is inverted at every two dots on a display line extending in the horizontal scan direction (two-dot inversion driving). The first to fourth polarity patterns are exemplary polarity patterns in such two-dot inversion driving.

Figure 15:
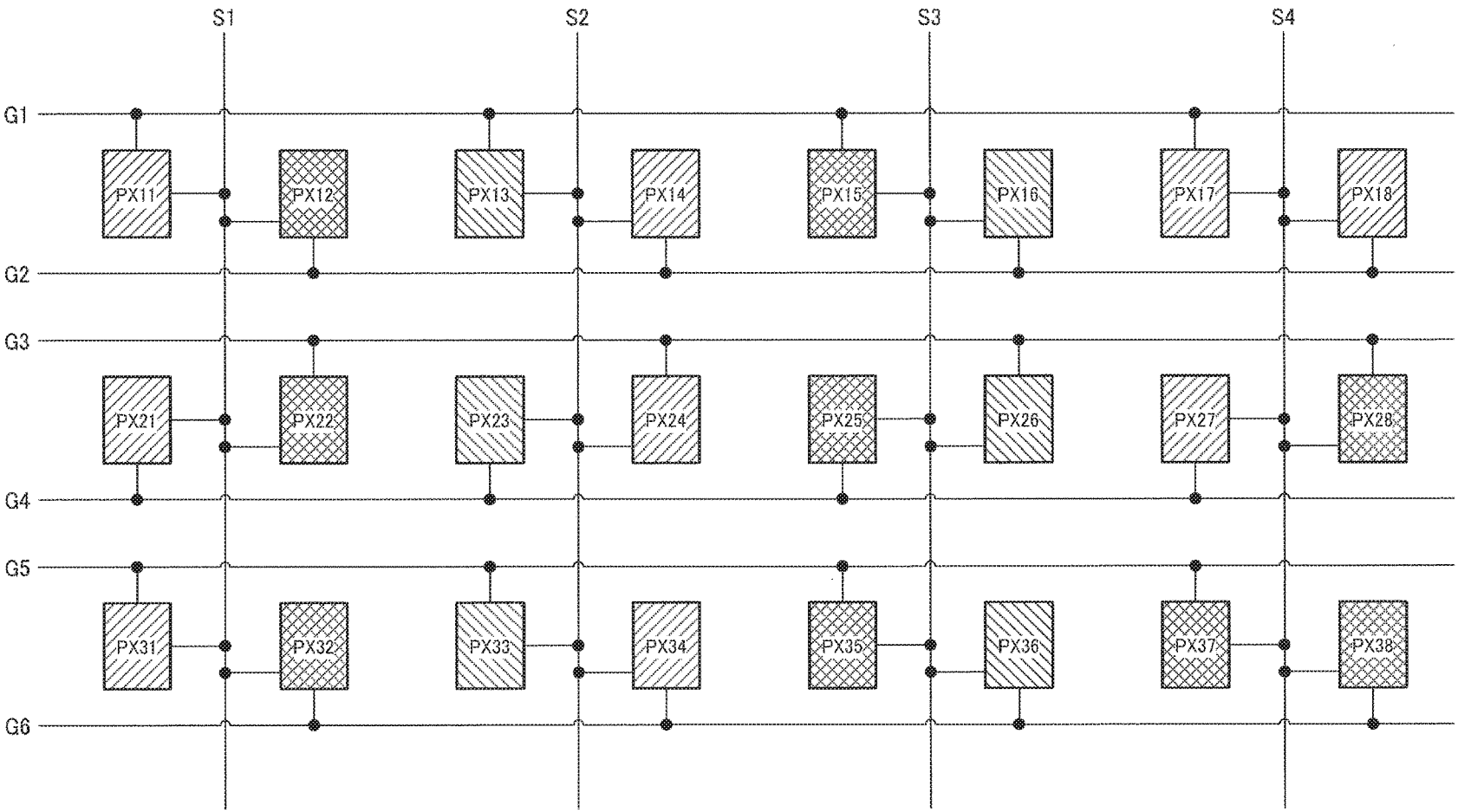
FIG. 15 shows a second exemplary configuration of the display panel.
Figure 16:
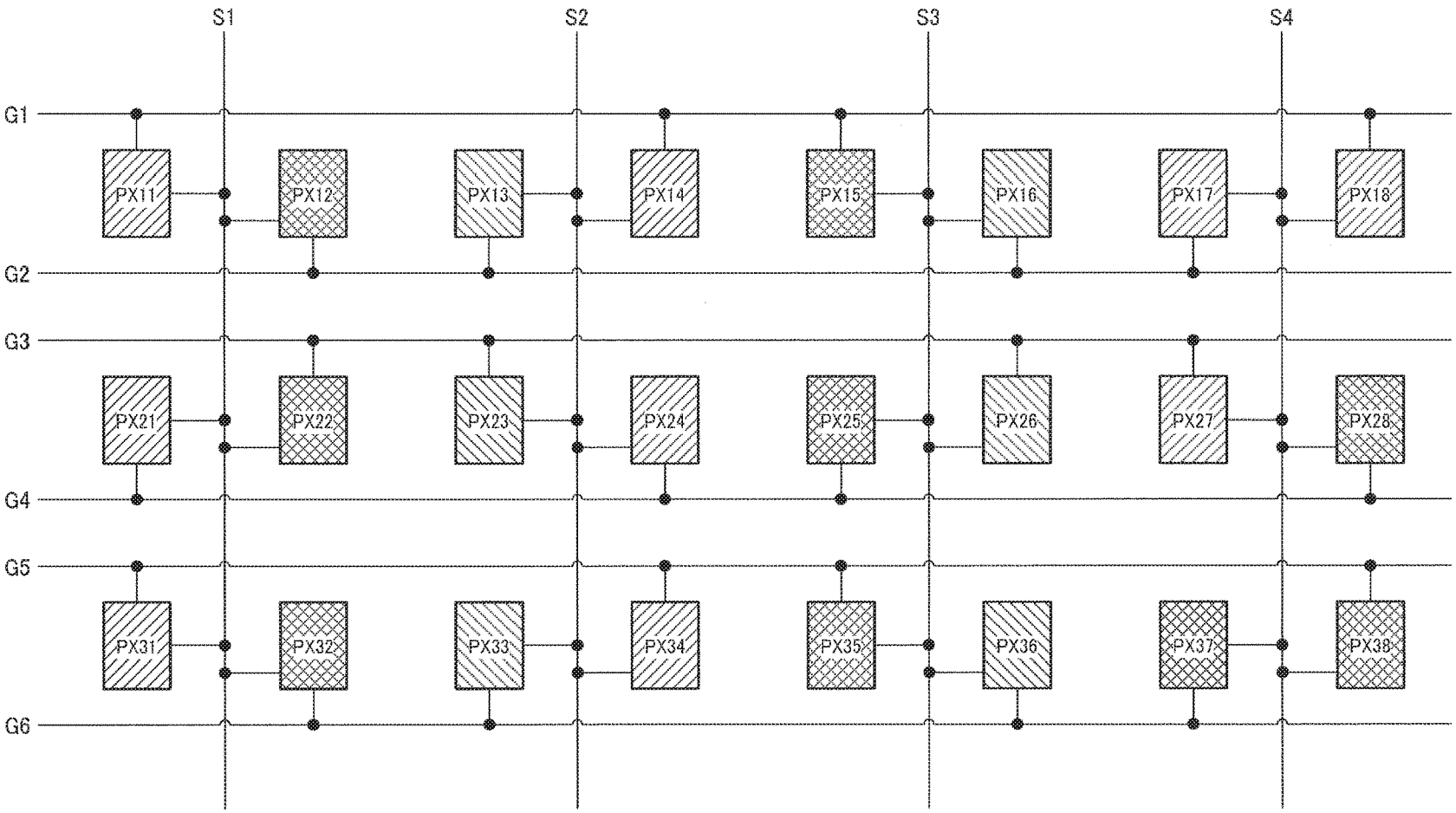
FIG. 16 shows a third exemplary configuration of the display panel.

Note that if the above polarity patterns are applied to display panels having other dual-gate structures, such as those shown in FIGS. 15 and 16, the correspondence between pixels and polarities changes. For example, it is assumed that the first polarity pattern is applied to the display panel in FIG. 15. In this case, regarding the pixels PX11 to PX14, the connection relationship with the scan lines G1 and G2 is the same as that in FIG. 10. Accordingly, the correspondence between pixels and polarities is the same. On the other hand, regarding the pixels PX21 to PX24, the pixels PX22 and PX24 are connected to the scan line G3, and the pixels PX21 and PX23 are connected to the scan line G4. Accordingly, negative and positive data voltages are written respectively in the pixels PX22 and PX24 (a fifth pixel and a seventh pixel) that are connected to the scan line G3, via the data lines S1 and S2. Positive and negative data voltages are written respectively in the pixels PX21 and PX23 (a sixth pixel and an eighth pixel) that are connected to the scan line G4, via the data lines S1 and S2.

Thus, even in the case of driving with the same polarity pattern, the layout of the polarities that ultimately appear on the display screen differs depending on the difference in the dual-gate structure. Therefore, the polarity pattern that is able to improve display quality the best differs depending on the type of dual-gate structure in some cases. The circuit device 100 according to this embodiment can drive a display panel with various polarity patterns as described above. Accordingly, the most suitable polarity pattern can be set in accordance with the type of dual-gate structure.

5. Display Panel

FIG. 14 shows a first exemplary configuration of the display panel. FIG. 15 shows a second exemplary configuration of the display panel. FIG. 16 shows a third exemplary configuration of the display panel. The circuit device 100 and an operational technique thereof according to this embodiment are applicable to any of the display panels having the first to third exemplary configurations.

Figure 17:
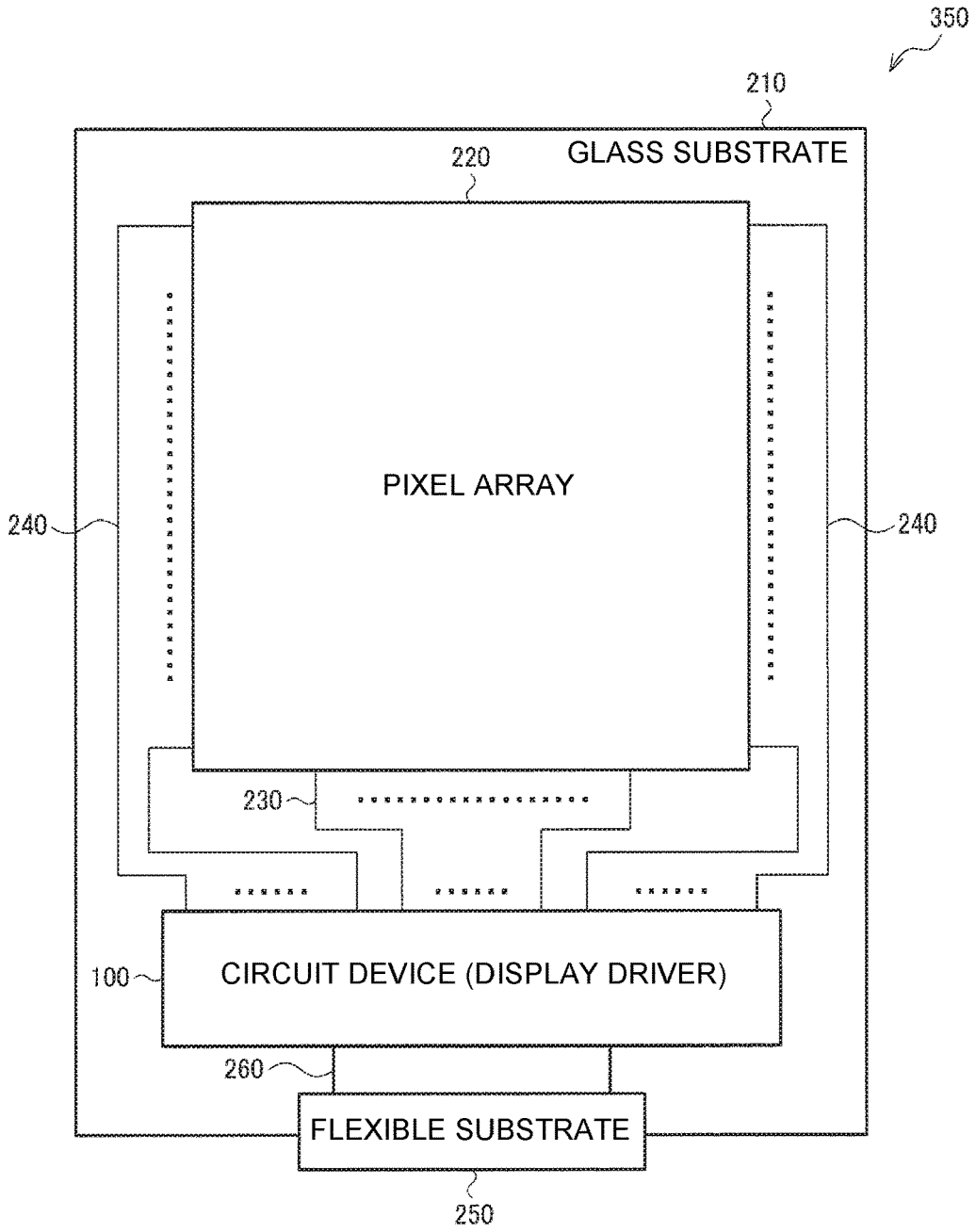
FIG. 17 shows an exemplary configuration of an electro-optical apparatus.

Each display panel includes a pixel array having pixels PX11 to PX38, data lines S1 to S4, and scan lines G1 to G6. In the pixel array, for example, a pixel in a first row of a second column is denoted by a sign PX12. "Row" refers to a line extending in the horizontal scan direction, and "column" refers to a line extending in the vertical scan direction. Note that FIGS. 15 to 17 show a part of the pixel arrays.

In the first exemplary configuration in FIG. 14, among the pixels PX11 to PX18 on the first display line, the pixels PX11, PX13, PX15, and PX17 are connected to the scan line G1 and correspond to a first pixel group. The pixels PX12, PX14, PX16, and PX18 are connected to the scan line G2 and correspond to a second pixel group. Regarding the pixels PX21 to PX28 on the second display line, the pixels PX21, PX23, PX25, and PX27 are connected to the scan line G3 and correspond to a third pixel group. The pixels PX22, PX24, PX26, and PX28 are connected to the scan line G4 and correspond to a fourth pixel group.

The pixel PX11 in the first pixel group and the pixel PX12 in the second pixel group are connected in common to the data line S1, and correspond respectively to a first pixel and a second pixel. The pixel PX13 in the first pixel group and the pixel PX14 in the second pixel group are connected in common to the data line S2, and correspond respectively to a third pixel and a fourth pixel. The pixel PX21 in the third pixel group and the pixel PX22 in the fourth pixel group are connected in common to the data line S1, and correspond respectively to a fifth pixel and a sixth pixel. The pixel PX23 in the third pixel group and the pixel PX24 in the fourth pixel group are connected in common to the data line S2, and correspond respectively to a seventh pixel and an eighth pixel.

In the second exemplary configuration in FIG. 15, the pixels PX11 to PX18 on the first display line have the same connection configuration as that in the first exemplary configuration. Regarding the pixels PX21 to PX28 on the second display line, the pixels PX22, PX24, PX26, and PX28 are connected to the scan line G3 and correspond to the third pixel group. The pixels PX21, PX23, PX25, and PX27 are connected to the scan line G4 and correspond to the fourth pixel group.

The pixel PX22 in the third pixel group and the pixel PX21 in the fourth pixel group are connected in common to the data line S1, and correspond respectively to the fifth pixel and the sixth pixel. The pixel PX24 in the third pixel group and the pixel PX23 in the fourth pixel group are connected in common to the data line S2, and correspond respectively to the seventh pixel and the eighth pixel.

In the third exemplary configuration in FIG. 16, regarding the pixels PX11 to PX18 on the first display line, the pixels PX11, PX14, PX15, and PX18 are connected to the scan line G1 and correspond to the first pixel group. The pixels PX12, PX13, PX16, and PX17 are connected to the scan line G2 and correspond to the second pixel group. Regarding the pixels PX21 to PX28 on the second display line, the pixels PX22, PX23, PX26, and PX27 are connected to the scan line G3 and correspond to the third pixel group. The pixels PX21, PX24, PX25, and PX28 are connected to the scan line G4 and correspond to the fourth pixel group.

The pixel PX11 in the first pixel group and the pixel PX12 in the second pixel group are connected in common to the data line S1, and correspond respectively to the first pixel and the second pixel. The pixel PX14 in the first pixel group and the pixel PX13 in the second pixel group are connected in common to the data line S2, and correspond respectively to the third pixel and the fourth pixel. The pixel PX22 in the third pixel group and the pixel PX21 in the fourth pixel group are connected in common to the data line S1, and correspond respectively to the fifth pixel and the sixth pixel. The pixel PX23 in the third pixel group and the pixel PX24 in the fourth pixel group are connected in common to the data line S2, and correspond respectively to the seventh pixel and the eighth pixel.

6. Electro-Optical Apparatus

FIG. 17 shows an exemplary configuration of an electro-optical apparatus 350 to which the circuit device 100 according to this embodiment is applicable. Although the following description takes a case where a display panel 200 is a matrix liquid crystal display panel as an example, the display panel 200 may alternatively be a display panel using self-light emitting elements (e.g. an EL (Electro-Luminescence) display panel) or the like.

The electro-optical apparatus 350 includes a glass substrate 210, a pixel array 220 formed on the glass substrate 210, the circuit device 100 mounted on the glass substrate 210, an interconnect group 230 that connects the circuit device 100 to data lines in the pixel array 220, an interconnect group 240 that connects the circuit device 100 to scan lines in the pixel array 220, a flexible substrate 250 that is connected to a display controller 300, and an interconnect group 260 that connects the flexible substrate 250 to the circuit device 100. The interconnect group 230, the interconnect group 240, and the interconnect group 260 are formed by a transparent electrode (ITO: Indium Tin Oxide) or the like on the glass substrate 210. The pixel array 220 includes the pixels, the data lines, and the scan lines, and the glass substrate 210 and the pixel array 220 correspond to the display panel 200. Note that the electro-optical apparatus may further include a substrate connected to the flexible substrate 250, and the display controller 300 mounted on this substrate.

7. Electronic Instrument

Figure 18:
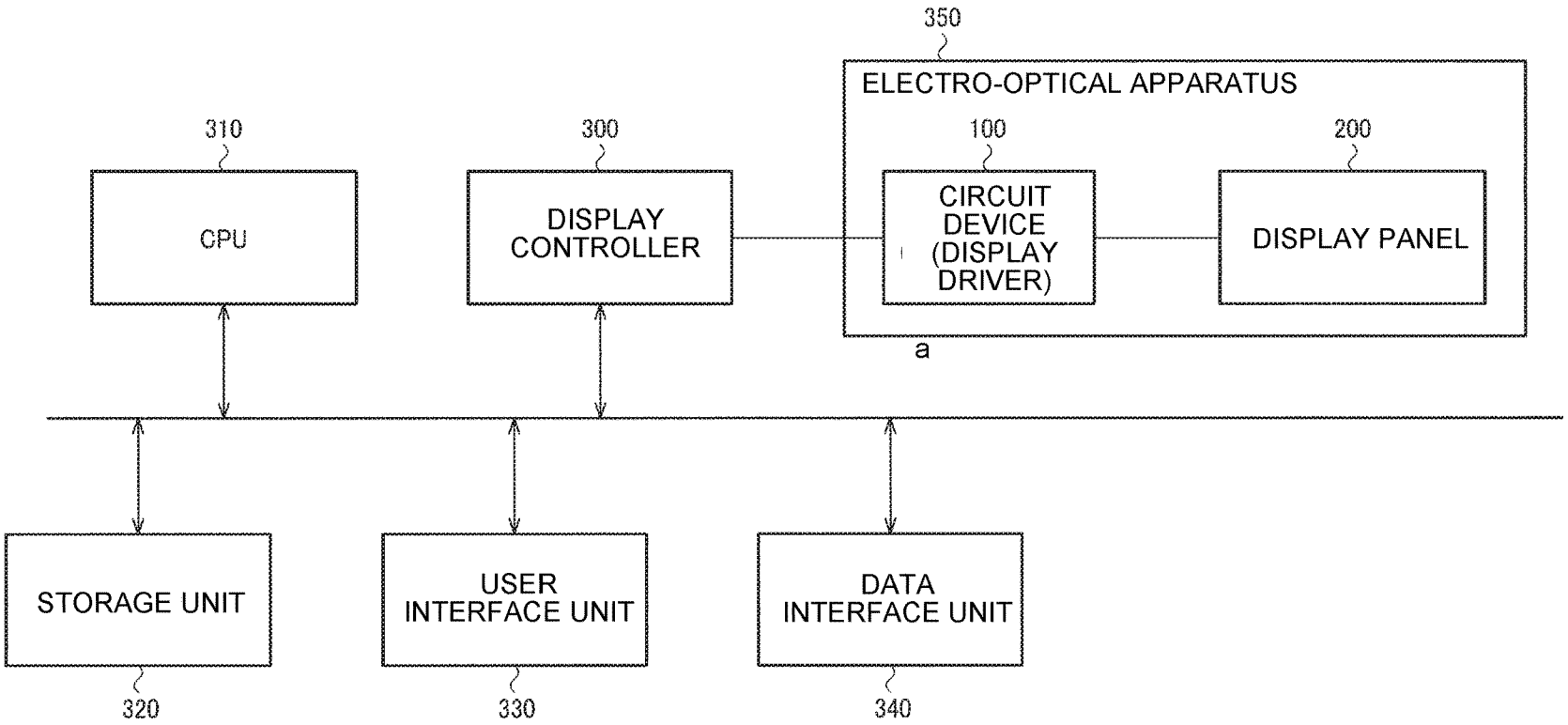
FIG. 18 shows an exemplary configuration of an electronic instrument.

FIG. 18 shows an exemplary configuration of an electronic instrument to which the circuit device 100 according to this embodiment is applicable. Conceivable electronic instruments according to this embodiment include various electronic instruments in which a display device is mounted, such as an in-vehicle display device (e.g. a meter panel), a monitor, a display, a single-panel projector, a television apparatus, an information processing apparatus (computer), a portable information terminal, a car navigation system, a portable gaming terminal, a DLP (Digital Light Processing) apparatus, and a printer.

The electronic instrument shown in FIG. 18 includes the electro-optical apparatus 350, a CPU 310 (in a broad sense, a processor), the display controller 300 (a host controller), a storage unit 320, a user interface unit 330, and a data interface unit 340. The electro-optical apparatus 350 includes the circuit device 100 and the display panel 200. Note that functions of the display controller 300 may be achieved by the CPU 310, and the display controller 300 may be omitted. A configuration may be employed in which the circuit device 100 and the display panel 200 are not integrally configured as the electro-optical apparatus 350 and are incorporated as individual constituent elements in the electronic instrument.

The user interface unit 330 is an interface unit that accepts various operations from a user. For example, the user interface unit 330 is constituted by buttons, a mouse, a keyboard, a touch panel provided in the display panel 200, or the like. The data interface unit 340 is an interface unit that inputs and outputs image data and control data. For example, the data interface unit 340 is a wired communication interface such as a USB, or a wireless communication interface such as a wireless LAN. The storage unit 320 stores image data that is input from the data interface unit 340. Alternatively, the storage unit 320 functions as a working memory for the CPU 310 and the display controller 300. The CPU 310 performs control processing for each part of the electronic instrument and various kinds of data processing. The display controller 300 performs control processing for the circuit device 100. For example, the display controller 300 converts image data transferred from the data interface unit 340 or the storage unit 320 via the CPU 310 into image data in a format that can be accepted by the circuit device 100, and outputs the converted image data to the circuit device 100. The circuit device 100 drives the display panel 200 based on the image data transferred from the display controller 300.

Note that although this embodiment has been described above in detail, those skilled in the art would readily understand that the embodiment is able to be modified in many ways without substantially departing from new matter and the effects of the invention. Accordingly, all such modifications are encompassed in the scope of the invention. For example, a term that is used with a different term having a broader or the same meaning at least once in the specification or the drawings may be replaced with this different term in any part of the specification or the drawings. All combinations of this embodiment and the modifications are also encompassed in the scope of the invention. Configurations, operation, and the like of the driving unit, the control unit, the polarity setting unit, the driving circuit, the circuit device, the electro-optical apparatus, and the electronic instrument are not limited to those described in this embodiment, and may be modified in various manners.

This application claims priority from Japanese Patent Application No. 2015-201981 filed in the Japanese Patent Office on Oct. 13, 2015 the entire disclosure of which is hereby incorporated by reference in its entirely.

What is claimed is:

1. A circuit device for driving a display panel that has a first pixel group selected by a first scan line, and a second pixel group selected by the second scan line, the first scan line and the second scan line being provided in correspondence with a first display line, and in which each of a plurality of data lines is shared by one pixel in the first pixel group and one pixel in the second pixel group, the circuit device comprising:

a driving unit that drives the display panel based on display data;

a control unit that controls the driving unit; and a polarity setting unit, wherein, in a first scanning period in which the first pixel group is selected by the first scan line, the driving unit outputs a data voltage with a first polarity, which is one of a positive polarity and a negative polarity, to a first data line in the plurality of data lines, and outputs a data voltage with a second polarity, which is a polarity opposite to the first polarity, to a second data line in the plurality of data lines, the first pixel group including a first pixel and a third pixel, in a second scanning period in which the second pixel group is selected by the second scan line, the driving unit outputs a data voltage with a third polarity, which is one of a positive polarity and a negative polarity, to the first data line, and outputs a data voltage with a fourth polarity, which is a polarity opposite to the third polarity, to the second data line, the second pixel group including a second pixel and a fourth pixel, the first pixel, the second pixel, the third pixel and the fourth pixel are provided in the first display line in sequential order from the first pixel to the fourth pixel, the data voltage for each of the first polarity, the third polarity, the second polarity, and the fourth polarity are written respectively in the first pixel, the second pixel, the third pixel, and the fourth pixel on the first display line, and the polarity setting unit sets the first polarity, the second polarity, the third polarity, and the fourth polarity.

2. The circuit device according to claim 1, wherein the driving unit includes a driving circuit provided in correspondence with the first data line and the second data line, and the driving circuit includes:

a positive-polarity amplifier circuit that outputs a positive voltage;

a negative-polarity amplifier circuit that outputs a negative voltage;

a first switching circuit that outputs, to the first data line, an output voltage from one of the positive-polarity amplifier circuit and the negative-polarity amplifier circuit, and a second switching circuit that outputs, to the second data line, an output voltage from the other one of the positive-polarity amplifier circuit and the negative-polarity amplifier circuit, the other one being different from the one of the positive-polarity amplifier circuit and the negative-polarity amplifier circuit.

3. The circuit device according to claim 1, the driving circuit includes:

a positive-polarity amplifier circuit that outputs a positive voltage;

a negative-polarity amplifier circuit that outputs a negative voltage;

a first switching circuit that outputs, to the first data line, an output voltage from one of the positive-polarity amplifier circuit and the negative-polarity amplifier circuit, and a second switching circuit that outputs, to the second data line, an output voltage from the other one of the positive-polarity amplifier circuit and the negative-polarity amplifier circuit, the other one being different from the one of the positive-polarity amplifier circuit and the negative-polarity amplifier circuit.

4. The circuit device according to claim 2, wherein in the first scanning period, the first switching circuit outputs a data voltage with the first polarity from the one of the positive-polarity amplifier circuit and the negative-polarity amplifier circuit to the first data line, and the second switching circuit outputs a data voltage with the second polarity from the other one of the positive-polarity amplifier circuit and the negative-polarity amplifier circuit to the second data line, and in the second scanning period, the first switching circuit outputs a data voltage with the third polarity from the one of the positive-polarity amplifier circuit and the negative-polarity amplifier circuit to the first data line, and the second switching circuit outputs a data voltage with the fourth polarity from the other one of the positive-polarity amplifier circuit and the negative-polarity amplifier circuit to the second data line.

5. The circuit device according to claim 2, wherein the driving unit includes:

a positive-polarity D/A conversion circuit provided on an upstream side of the positive-polarity amplifier circuit; and a negative-polarity D/A conversion circuit provided on an upstream side of the negative-polarity amplifier circuit.

6. The circuit device according to claim 5, wherein the driving unit includes:

a positive-polarity gray level voltage generation circuit that supplies a plurality of positive-polarity gray level voltages to the positive-polarity D/A conversion circuit; and a negative-polarity gray level voltage generation circuit that supplies a plurality of negative-polarity gray level voltages to the negative-polarity D/A conversion circuit.

7. The circuit device according to claim 1, wherein the first data line is shared by the first pixel and the second pixel, and the second data line is shared by the third pixel and the fourth pixel, in the first scanning period, the driving unit outputs a data voltage with the first polarity for the first pixel to the first data line shared by the first pixel and the second pixel, and outputs a data voltage with the second polarity for the third pixel to the second data line shared by the third pixel and the fourth pixel, and in the second scanning period, the driving unit outputs a data voltage with the third polarity for the second pixel to the first data line, and outputs a data voltage with the fourth polarity for the fourth pixel to the second data line.

8. The circuit device according to claim 1, wherein the display panel has a third pixel group selected by a third scan line, and a fourth pixel group selected by the fourth scan line, the third scan line and the fourth scan line being provided in correspondence with a second display line, and each of the plurality of data lines is shared by one pixel in the third pixel group and one pixel in the fourth pixel group, in the first scanning period in which the first pixel group is selected by the first scan line, the driving unit outputs a positive data voltage to the first data line, and outputs a negative data voltage to the second data line, in the second scanning period in which the second pixel group is selected by the second scan line, the driving unit outputs a positive data voltage to the first data line, and outputs a negative data voltage to the second data line, in a third scanning period in which the third pixel group is selected by the third scan line, the driving unit outputs a negative data voltage to the first data line, and outputs a positive data voltage to the second data line, and in a fourth scanning period in which the fourth pixel group is selected by the fourth scan line, the driving unit outputs a positive data voltage to the first data line, and outputs a negative data voltage to the second data line.

9. A circuit device for driving a display panel that has a first pixel group selected by a first scan line, a second pixel group selected by the second scan line, the first scan line and the second scan line being provided in correspondence with a first display line, a third pixel group selected by a third scan line, and a fourth pixel group selected by the fourth scan line, the third scan line and the fourth scan line being provided in correspondence with a second display line, and in which each of a plurality of data lines is shared by one pixel in the first pixel group and one pixel in the second pixel group, and is shared by one pixel in the third pixel group and one pixel in the fourth pixel group, the circuit device comprising:

a driving unit that drives the display panel based on display data; and a control unit that controls the driving unit, wherein in a first scanning period in which the first pixel group is selected by the first scan line, the driving unit outputs a positive data voltage to a first pixel at a first data line, and outputs a negative data voltage to a third pixel at a second data line, the first pixel group including the first pixel and the third pixel, in a second scanning period in which the second pixel group is selected by the second scan line, the driving unit outputs a positive data voltage to a second pixel at the first data line, and outputs a negative data voltage to a fourth pixel at the second data line, the second pixel group including the second pixel and the fourth pixel, in a third scanning period in which the third pixel group is selected by the third scan line, the driving unit outputs a negative data voltage to a fifth pixel at the first data line, and outputs a positive data voltage to a seventh pixel at the second data line, the third pixel group including the fifth pixel and the seventh pixel, in a fourth scanning period in which the fourth pixel group is selected by the fourth scan line, the driving unit outputs a positive data voltage to a sixth pixel at the first data line, and outputs a negative data voltage to an eighth pixel at the second data line, the fourth pixel group including the sixth pixel and the eighth pixel, the first pixel, the second pixel, the third pixel and the fourth pixel are provided in a first display line in sequential order from the first pixel to the fourth pixel, and the fifth pixel, the sixth pixel, the seventh pixel and the eighth pixel are provided in a second display line in sequential order from the fifth pixel to the eighth pixel.

10. The circuit device according to claim 8, wherein the first data line is shared by the first pixel and the second pixel, the second data line is shared by the third pixel and the fourth pixel, the first data line is shared by a fifth pixel, which is a pixel in the third pixel group, and a sixth pixel, which is a pixel in the fourth pixel group, and the second data line is shared by a seventh pixel, which is a pixel in the third pixel group, and an eighth pixel, which is a pixel in the fourth pixel group, in the first scanning period, the driving unit outputs a positive data voltage for the first pixel to the first data line, and outputs a negative data voltage for the third pixel to the second data line, in the second scanning period, the driving unit outputs a positive data voltage for the second pixel to the first data line, and outputs a negative data voltage for the fourth pixel to the second data line, in the third scanning period, the driving unit outputs a negative data voltage for the fifth pixel to the first data line, and outputs a positive data voltage for the seventh pixel to the second data line, and in the fourth scanning period, the driving unit outputs a positive data voltage for the sixth pixel to the first data line, and outputs a negative data voltage for the eighth pixel to the second data line.

11. The circuit device according to claim 8, wherein the display panel has a fifth pixel group selected by a fifth scan line, a sixth pixel group selected by the sixth scan line, the fifth scan line and the sixth scan line being provided in correspondence with a third display line, a seventh pixel group selected by a seventh scan line, and an eighth pixel group selected by the eighth scan line, the seventh scan line and the eighth scan line being provided in correspondence with a fourth display line, and in the display panel, each of the plurality of data lines is shared by one pixel in the fifth pixel group and one pixel in the sixth pixel group, and is shared by one pixel in the seventh pixel group and one pixel in the eighth pixel group, in a fifth scanning period in which the fifth pixel group is selected by the fifth scan line, the driving unit outputs a negative data voltage to the first data line, and outputs a positive data voltage to the second data line, in a sixth scanning period in which the sixth pixel group is selected by the sixth scan line, the driving unit outputs a negative data voltage to the first data line, and outputs a positive data voltage to the second data line, in a seventh scanning period in which the seventh pixel group is selected by the seventh scan line, the driving unit outputs a positive data voltage to the first data line, and outputs a negative data voltage to the second data line, and in an eighth scanning period in which the eighth pixel group is selected by the eighth scan line, the driving unit outputs a negative data voltage to the first data line, and outputs a positive data voltage to the second data line.

12. The circuit device according to claim 11, wherein the first data line is shared by a ninth pixel, which is a pixel in the fifth pixel group, and a tenth pixel, which is a pixel in the sixth pixel group, the second data line is shared by an eleventh pixel, which is a pixel in the fifth pixel group, and a twelfth pixel, which is a pixel in the sixth pixel group, the first data line is shared by a thirteenth pixel, which is a pixel in the seventh pixel group, and a fourteenth pixel, which is a pixel in the eighth pixel group, and the second data line is shared by a fifteenth pixel, which is a pixel in the seventh pixel group, and a sixteenth pixel, which is a pixel in the eighth pixel group, in the fifth scanning period, the driving unit outputs a negative data voltage for the ninth pixel to the first data line shared by the ninth pixel and the tenth pixel, and outputs a positive data voltage for the eleventh pixel to the second data line shared by the eleventh pixel and the twelfth pixel, in the sixth scanning period, the driving unit outputs a negative data voltage for the tenth pixel to the first data line, and outputs a positive data voltage for the twelfth pixel to the second data line, in the seventh scanning period, the driving unit outputs a positive data voltage for the thirteenth pixel to the first data line shared by the thirteenth pixel and the fourteenth pixel, and outputs a negative data voltage for the fifteenth pixel to the second data line shared by the fifteenth pixel and the sixteenth pixel, and in the eighth scanning period, the driving unit outputs a negative data voltage for the fourteenth pixel to the first data line, and outputs a positive data voltage for the sixteenth pixel to the second data line.

13. An electro-optical apparatus comprising:

the circuit device according to claim 1; and the display panel.

14. An electronic instrument comprising the circuit device according to claim 1.

* * * * *